US010785579B2

(12) United States Patent
Aase et al.

(10) Patent No.: US 10,785,579 B2
(45) Date of Patent: Sep. 22, 2020

(54) HEARING ASSISTANCE DEVICE WITH AN ACCELEROMETER

(71) Applicant: Eargo, Inc., Mountain View, CA (US)

(72) Inventors: Jonathan Sarjeant Aase, Sunnyvale, CA (US); Jeffrey Baker, Newbury Park, CA (US); Beau Polinske, Minneapolis, MN (US); Gints Klimanis, Cupertino, CA (US)

(73) Assignee: Eargo, Inc., Mountain View, CA (US)

( * ) Notice: Subject to any disclaimer, the term of this patent is extended or adjusted under 35 U.S.C. 154(b) by 0 days.

(21) Appl. No.: 16/254,362

(22) Filed: Jan. 22, 2019

(65) Prior Publication Data

US 2019/0230450 A1 Jul. 25, 2019

Related U.S. Application Data

(60) Provisional application No. 62/621,422, filed on Jan. 24, 2018.

(51) Int. Cl.
*H04R 25/00* (2006.01)
*H04R 1/10* (2006.01)

(52) U.S. Cl.
CPC ..... *H04R 25/505* (2013.01); *H04R 1/1016* (2013.01); *H04R 1/1041* (2013.01); *H04R 25/305* (2013.01); *H04R 25/405* (2013.01); *H04R 25/55* (2013.01); *H04R 25/65* (2013.01); *H04R 2225/31* (2013.01); *H04R 2225/41* (2013.01); *H04R 2460/09* (2013.01)

(58) Field of Classification Search
CPC ..... H04R 25/505; H04R 1/1041; H04R 25/1016; H04R 2225/31; H04R 25/305; H04R 25/405; H04R 25/55; H04R 25/65
USPC ..... 381/312
See application file for complete search history.

(56) References Cited

U.S. PATENT DOCUMENTS

| | | | | |
|---|---|---|---|---|
| 8,457,337 | B2 | 6/2013 | Michel et al. | |
| 8,577,067 | B2 | 11/2013 | Michel et al. | |
| 9,167,363 | B2 | 10/2015 | Michel et al. | |
| 9,344,819 | B2 | 5/2016 | Michel et al. | |
| 9,432,781 | B2 | 8/2016 | Herscher | |
| 9,826,322 | B2 | 11/2017 | Shen et al. | |
| 9,866,978 | B2 | 1/2018 | Michel et al. | |
| 9,936,311 | B2 | 4/2018 | Herscher | |
| 10,097,936 | B2 | 10/2018 | Barrett et al. | |
| 2014/0321682 | A1* | 10/2014 | Kofod-Hansen .... | H04R 25/305 381/315 |
| 2016/0313404 | A1 | 10/2016 | Herscher | |
| 2019/0246194 | A1* | 8/2019 | Aase ..... | H04R 1/1041 |

FOREIGN PATENT DOCUMENTS

| | | | | |
|---|---|---|---|---|
| EP | 3264798 | A1 * | 1/2018 | ..... H04R 25/558 |

* cited by examiner

*Primary Examiner* — Phylesha Dabney
(74) *Attorney, Agent, or Firm* — Rutan & Tucker, LLP

(57) ABSTRACT

A hearing assistance device is discussed that has one or more accelerometers, a user interface, and optionally a left/right determination module is configured to receive input data from the one or more accelerometers from user actions causing control signals as sensed by the accelerometers to trigger a program change for an audio configuration for the device selected from a group consisting of a change in amplification/volume control, a change in a mute mode, a change of a hearing loss profile loaded into that hearing assistance device, and a change in a play-pause mode.

16 Claims, 26 Drawing Sheets

Walking

Walking and stopping to Tap

HEARING ASSISTANCE DEVICE WITH AN ACCELEROMETER

RELATED APPLICATIONS

This application claims priority to under 35 USC 119 and incorporates U.S. provisional patent application Ser. No. 62/621,422, titled 'A hearing assistance device with an accelerometer,' filed Jan. 24, 2018, the disclosure of which is incorporated herein by reference in its entirety.

NOTICE OF COPYRIGHT

A portion of the disclosure of this patent application contains material that is subject to copyright protection. The copyright owner has no objection to the facsimile reproduction by anyone of the software engine and its modules, as it appears in the United States Patent & Trademark Office's patent file or records, but otherwise reserves all copyright rights whatsoever.

FIELD

Embodiments of the design provided herein generally relate to hearing assist systems and methods. For example, embodiments of the design provided herein can relate to hearing aids.

BACKGROUND

Today, hearing aids are labeled "left" or "right" with either markings (laser etch, pad print, etc.), or by color (red for right, etc.), forcing the user to figure out which device to put in which ear, and the manufacturing systems to create unique markings. Also, some hearing aids use "cupped clap" of the hand over the ear to affect that hearing aid.

SUMMARY

Provided herein in some embodiments is a user interface configured to cooperate with input data from one or more sensors in order to make a determination and recognize whether a device is inserted and/or installed on the left or right side of a user. In an embodiment, the user interface cooperating with the sensors may be implemented in a hearing assistance device.

In an embodiment, the hearing assistance device having one or more accelerometers and a user interface is configured to receive input data from the one or more accelerometers from user actions causing control signals as sensed by the accelerometers to trigger a program change for an audio configuration for the device selected from a group consisting of a change in amplification/volume control, a change in a mute mode, a change of a hearing loss profile loaded into that hearing assistance device, and a change in a play-pause mode.

These and other features of the design provided herein can be better understood with reference to the drawings, description, and claims, all of which form the disclosure of this patent application.

DRAWINGS

The drawings refer to some embodiments of the design provided herein in which.

Figure 14:
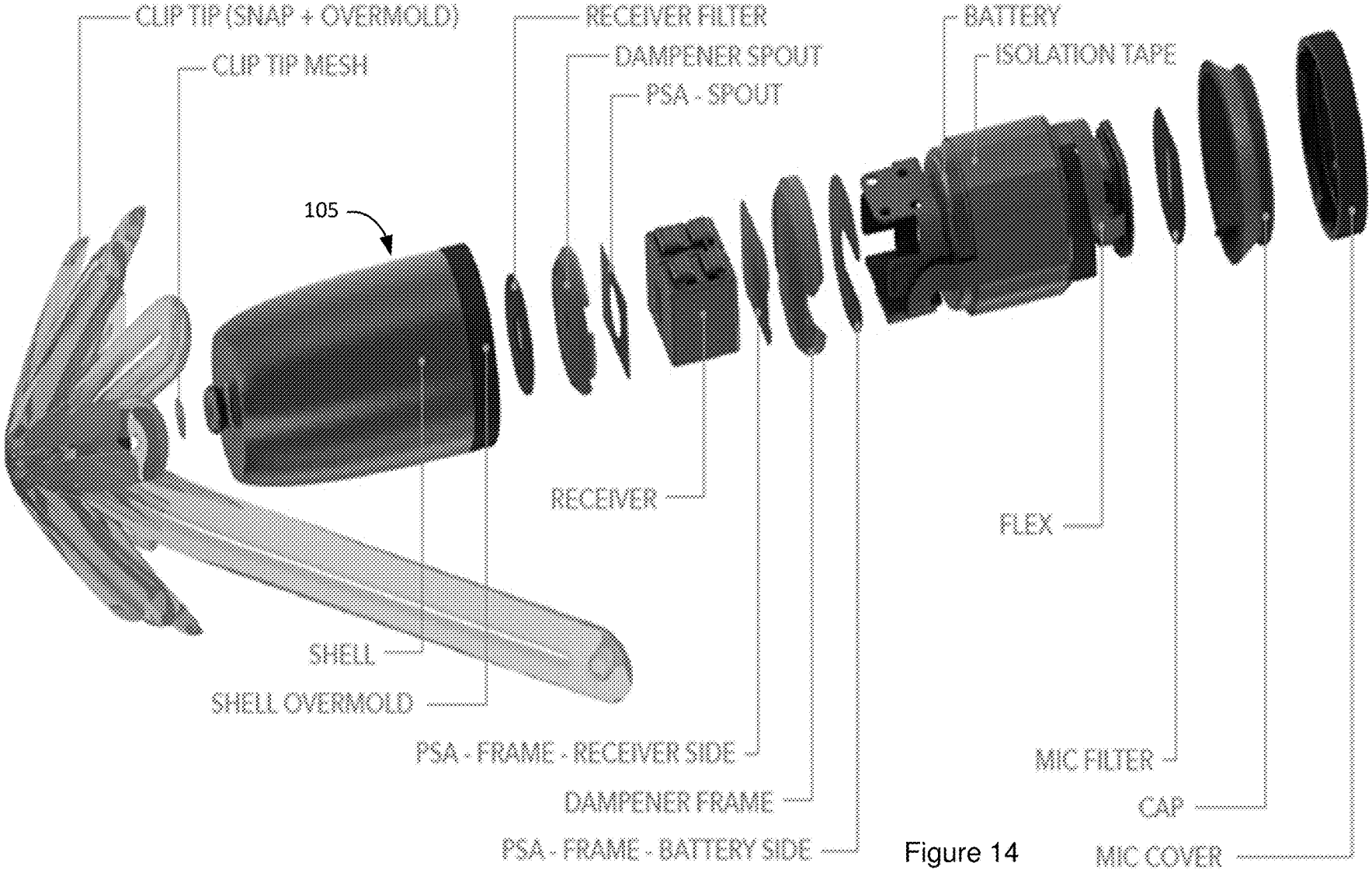

FIG. 14 illustrates an embodiment of an exploded view of an example hearing assistance device that includes an accelerometer, a microphone, a power control module, a clip tip with the snap attachment and overmold, a clip tip mesh, petals/fingers of the clip tip, a shell, a shell overmold, a receiver filter, a dampener spout, a PSA spout, a receiver, a PSA frame receive side, a dampener frame, a PSA frame battery slide, a battery, isolation tape around the compartment holding the accelerometer, other sensors, modules, etc., a flex, a microphone filter, a cap, a microphone cover, and other components.

Figure 15:
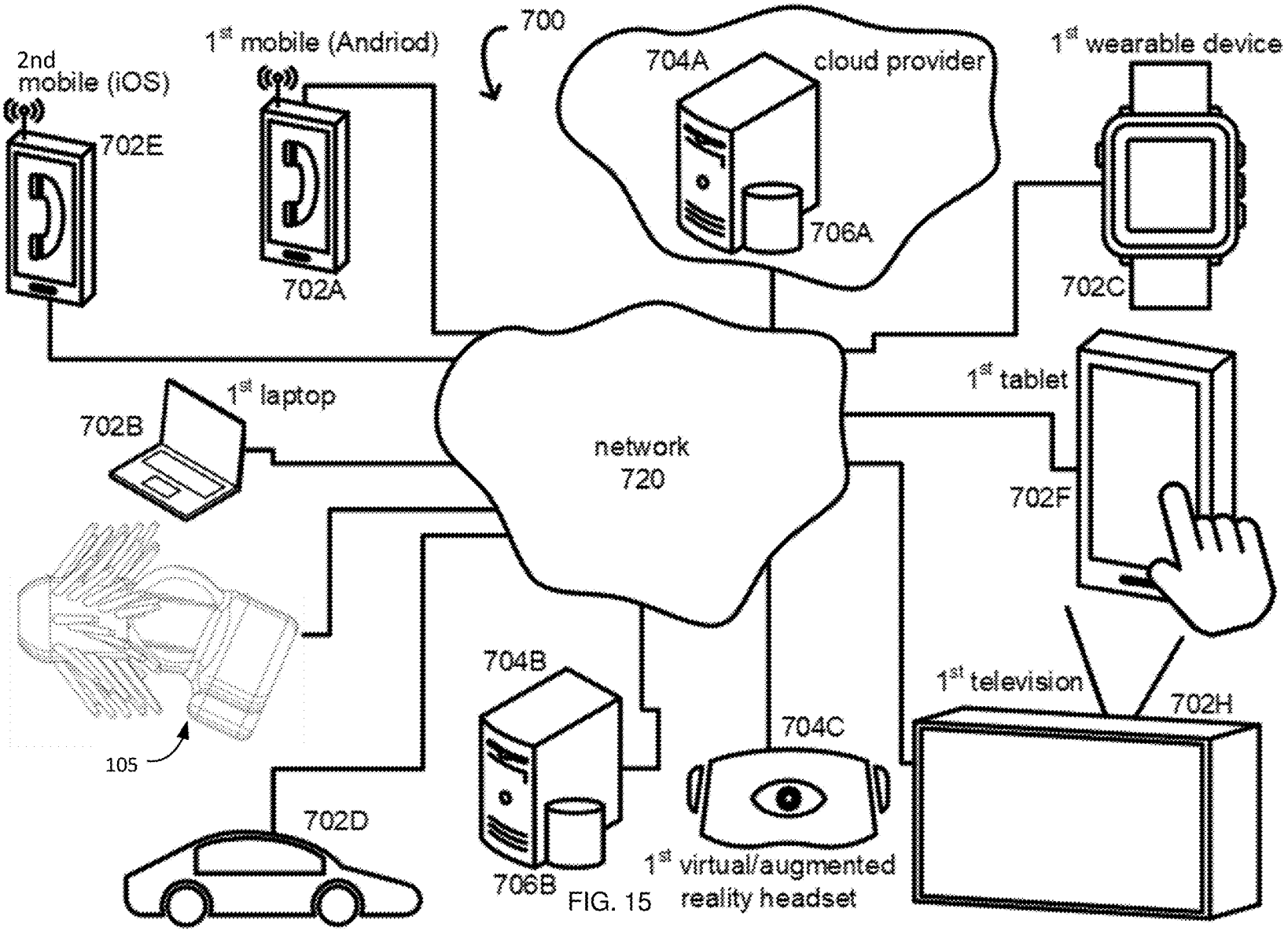

FIG. 15 illustrates a number of electronic systems including the hearing assistance device communicating with each other in a network environment.

Figure 16:
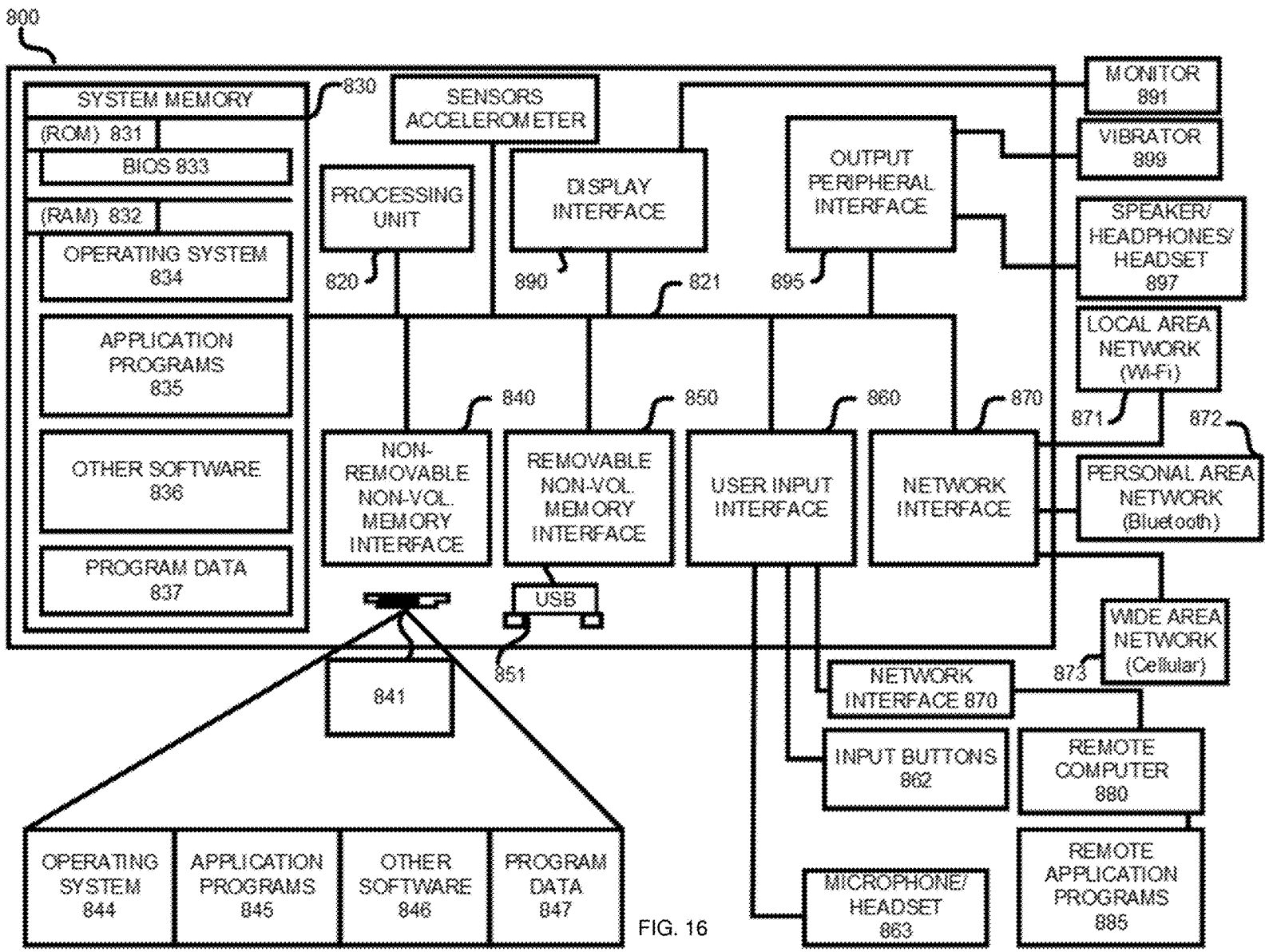

FIG. 16 illustrates a computing system that can be part of one or more of the computing devices such as the mobile phone, portions of the hearing assistance device, etc. in accordance with some embodiments.

While the design is subject to various modifications, equivalents, and alternative forms, specific embodiments thereof have been shown by way of example in the drawings and will now be described in detail. It should be understood that the design is not limited to the particular embodiments disclosed, but—on the contrary—the intention is to cover all modifications, equivalents, and alternative forms using the specific embodiments.

DESCRIPTION

In the following description, numerous specific details are set forth, such as examples of specific data signals, named components, etc., in order to provide a thorough understanding of the present design. It will be apparent, however, to one of ordinary skill in the art that the present design can be practiced without these specific details. In other instances, well known components or methods have not been described in detail but rather in a block diagram in order to avoid unnecessarily obscuring the present design. Further, specific numeric references such as a first accelerometer, can be made. However, the specific numeric reference should not be interpreted as a literal sequential order but rather interpreted that the first accelerometer is different than a second accelerometer. Thus, the specific details set forth are merely exemplary. The specific details can be varied from and still be contemplated to be within the spirit and scope of the present design. The term coupled is defined as meaning connected either directly to the component or indirectly to the component through another component. Also, an application herein described includes software applications, mobile apps, programs, and other similar software executables that are either stand-alone software executable files or part of an operating system application.

FIG. 16 (a computing system) and FIG. 15 (a network system) show examples in which the design disclosed herein can be practiced. In an embodiment, this design may include a small, limited computational system, such as those found within a physically small digital hearing aid; and in addition, how such computational systems can establish and communicate via wireless a communication channel to utilize a larger, powerful computational system, such as the computational system located in a mobile device. The small computational system may be limited in processor throughput and/or memory space.

In general, the hearing assistance device has one or more accelerometers and a user interface. The user interface may receive input data from the one or more accelerometers from user actions to cause control signals as sensed by the accelerometers to trigger a program change for an audio configuration for the device. The program changes can be a change in amplification/volume control, a change in a mute mode, a change of a hearing loss profile loaded into that hearing assistance device, and a change in a play/pause mode.

In an embodiment, the hearing assistance device can include a number of sensors including a small accelerometer and a signal processor, such as a DSP, mounted to the circuit board assembly. The accelerometer is assembled in a known orientation relative to the hearing assistance device. The accelerometer measures the dynamic acceleration forces caused by moving as well as the constant force of gravity. When the user moves around, the accelerometer measures the dynamic acceleration forces caused by moving and the hearing assistance device will be sensed by the accelerometer.

The user interface configured to cooperate with input data from one or more sensors in order to make a determination and recognize whether a device is inserted and/or installed on the left or right side of a user may be implemented in a number of different devices such as a hearing assistance device, a watch, or other similar device. The hearing assistance device may use one or more sensors, including one or more accelerometers, to recognize the device's installation in the left or right ear of the user, to manually change sound profiles loaded in hearing assistance device, and accomplish other new features. The hearing assistance device could be applied to any wearable device where sensing position relative to the body and/or a control UI would be useful (ex: headphones, glasses, helmets, etc.).

Figure 2A:
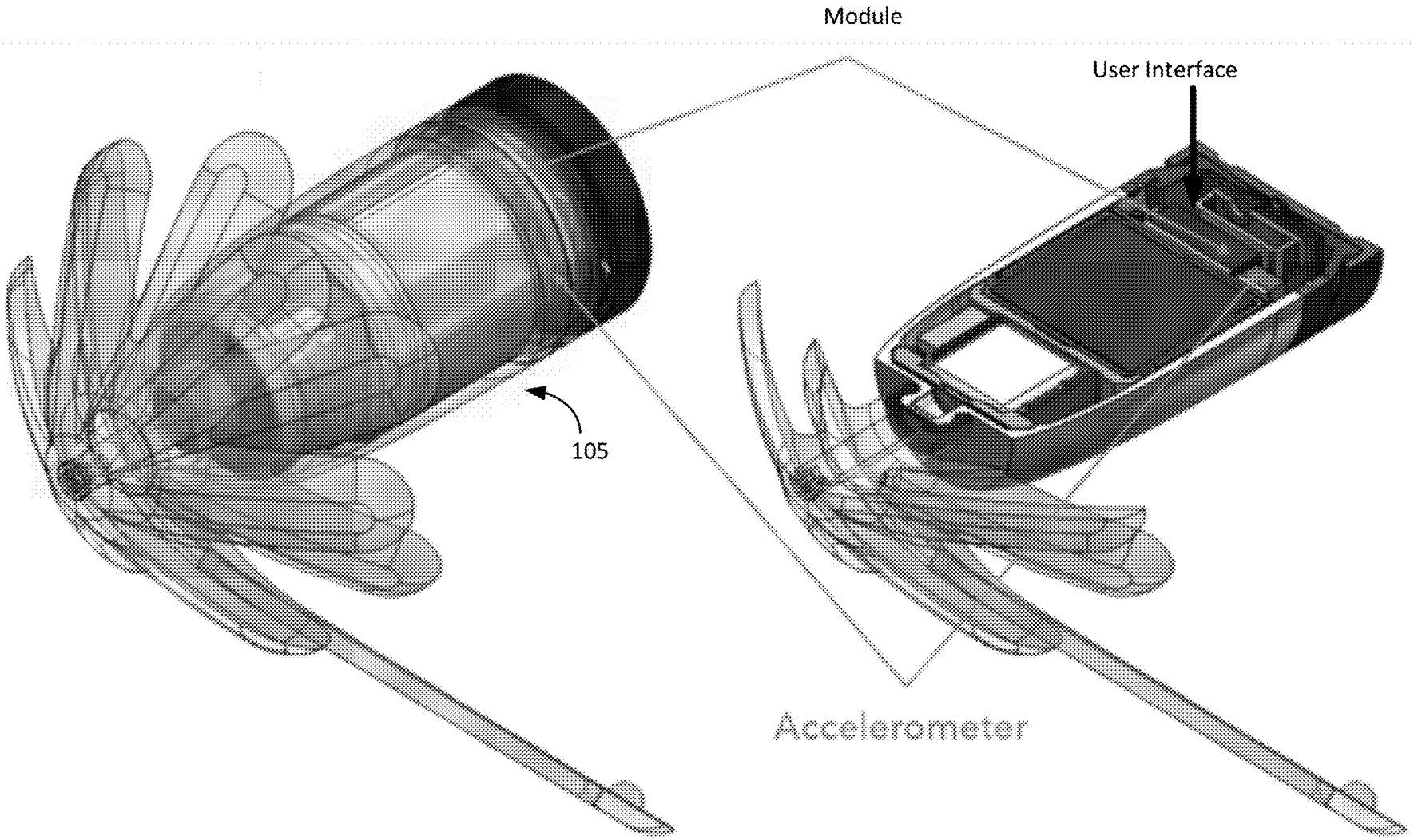
FIG. 2A illustrates an embodiment of a block diagram of an example hearing assistance device with an accelerometer and its cut away view of the hearing assistance device.

FIG. 2A illustrates an embodiment of a block diagram of an example hearing assistance device 105 with an accelerometer and its cut away view of the hearing assistance device 105. The diagram shows the location of the left/right determination module, a memory and processor to execute the user interface, and the accelerometer both in the cutaway view of the hearing assistance device 105 and positionally in the assembled view of the hearing assistance device 105. The accelerometer is electrically and functionally coupled to the left/right determination module and its signal processor, such as a digital signal processor.

The hearing assistance device 105 has one or more accelerometers and a user interface. The user interface may receive input data from the one or more accelerometers from user actions causing control signals as sensed by the accelerometers to trigger a program change for an audio configuration for the device selected from a group consisting of a change in amplification/volume control, a change in a mute mode, a change of a hearing loss profile loaded into that hearing assistance device 105, and a change in a play/pause mode.

The user interface is configured to use the input data from the one or more accelerometers in cooperation with input data from one or more additional sensors including but not limited to input data from the accelerometers in combination with audio input data from a microphone, and input data from the accelerometers in combination with input data from a gyroscope to trigger the program change and/or specify which one of the program changes is attempting to be triggered.

Figure 2B:
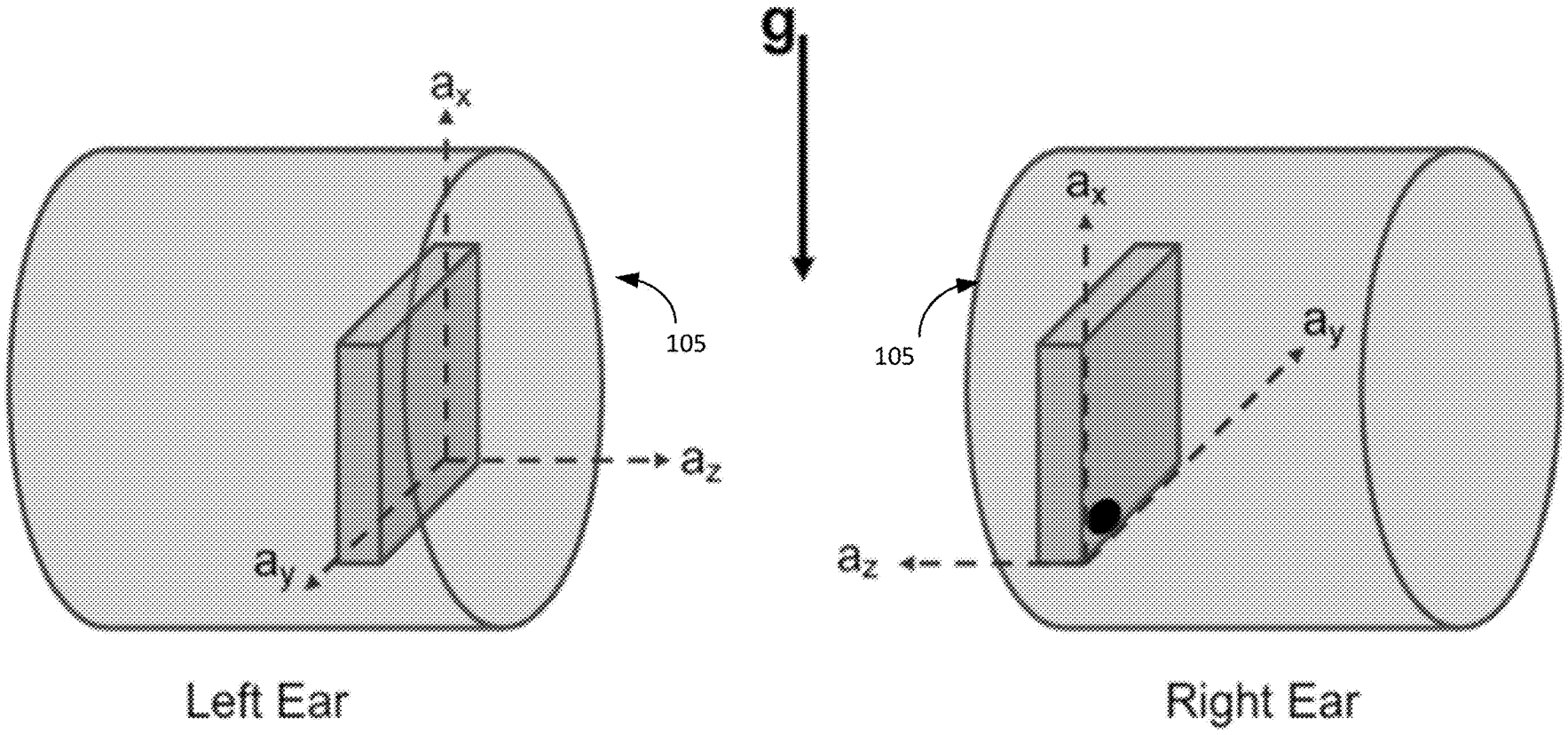
FIG. 2B illustrates an embodiment of a block diagram of an example hearing assistance device with the accelerometer axes and the accelerometer inserted in the body frame for a pair of hearing assistance devices 105.

FIG. 2B illustrates an embodiment of a block diagram of an example hearing assistance device 105 with the accelerometer axes and the accelerometer inserted in the body frame for a pair of hearing assistance devices 105. The user interface is configured to cooperate with a left/right determination module.

Vectors from the one or more accelerometers are used to recognize the hearing assistance device's orientation relative to a coordinate system reflective of the user's left and right ears. One or more algorithms in a left/right determination module analyze the vectors on the coordinate system and determine whether the device is currently installed on the left or right side of a user's head. The user interface uses this information to decipher user actions, including sequences of user actions, to cause control signals, as sensed by the accelerometers, to trigger the program change for the audio configuration.

Left/Right Recognition

The hearing assistance device 105 may use one or more sensors to recognize the device's orientation relative to a coordinate system (e.g. see FIG. 2B). The hearing assistance device 105 may use at least an accelerometer coupled to a signal processor, such as a DSP, to sense which hearing assistance device 105 is in the left/right ear (See FIG. 2A).

The pair of hearing assistance devices 105 are configured to recognize which ear each hearing assistance device 105 is inserted into; therefore, removing any burden upon the user to insert a specific hearing assistance device 105 into the correct ear. This design also eliminates a need for external markings, such as 'IR' or 'L' or different colors for left and right, in order for the user to insert them correctly. Note, hearing loss often is different in the left and right ears, requiring different sound augmentation to be loaded into the left/right hearing assistance devices 105. Both profiles will be stored in for each hearing assistance device 105. This design enables the hearing assistance device 105 to use the one or more sensors to recognize the device's orientation relative to a coordinate system to then recognize which ear the device has been inserted into. Once the hearing assistance device 105 recognizes which ear the device has been inserted into, then the software will automatically upload the appropriate sound profile for that ear, if needed (e.g. See FIG. 5).

The hearing assistance device 105 includes a small accelerometer and signal processor mounted to the circuit board assembly (See FIG. 2A). The accelerometer is assembled in a known orientation relative to the hearing assistance device 105. The accelerometer is mounted inside the hearing assistance device 105 to the PCBA. The PCBA is assembled via adhesives/battery/receiver/dampeners to orient the accelerometer repeatably relative to the enclosure form. The accelerometer measures the dynamic acceleration forces caused by moving as well as the constant force of gravity. The hearing assistance device's outer form may be designed such that it is assembled into the ear canal with a repeatable orientation relative to the head coordinate system (See FIGS. 4-7). This will allow the hearing assistance device 105 to know the gravity vector relative to the accelerometer and the head coordinate system. In one example, the system can first determine the gravity vector coming from the accelerometer to an expected gravity vector for a properly inserted and orientated hearing assistance device 105. The system may normalize the current gravity vector for the current installation and orientation of that hearing assistance device 105 (See FIGS. 9-11 for possible rotations of the location of the accelerometer and corresponding gravity vector). The hearing assistance devices 105 are installed in both ears at the relatively known orientation.

The hearing assistance device 105 may be configured to determine whether it is inserted in the right vs. left ear using the accelerometer. Thus, the hearing assistance device 105 prompts the user.

In an embodiment, the design is azimuthally symmetric; and thus, the x and y acceleration axes are in random directions. Yet, the system does know that the +z axes points into the head on each side, plus or minus the vertical and horizontal tilt of the ear canals, and that gravity is straight down.

Several example schemes may be implemented.

In an embodiment, the structure of the hearing assistance device 105 is such that you can guarantee that the grab-post of the device will be pointing down. The hearing assistance device 105 may assume that the grab stick is down, so the accelerometer body frame Ax is roughly anti-parallel with gravity (see FIG. 2B). Accordingly, the acceleration vector in the Ax axis is roughly anti-parallel with gravity. The system may issue a voice prompt to have the user take several steps. From this position, the hearing assistance device 105 may integrate or average the acceleration, especially the acceleration vector in the Ay axis, during forward walking. The system may then use the accumulated acceleration vector in the Ay axis, which will be positive in the right ear and negative in the left ear.

In this embodiment when the grab stick is not guaranteed to be at the bottom, either because of azimuthal symmetry or because it may seem difficult to enforce that user behavior, then there is another approach. The Az vector is guaranteed to point roughly into the head on each side. Immediately after insertion the system will prompt the user to tilt to the right. The system will expect that the Az vector will become more negative in the right ear, and more positive in the left ear. This approach would also work if the grab stick is at the bottom. Thus, the system may give the user prompts for motion, such as "tilt head to right for two seconds." If the hearing assistance device 105 is inserted in the right ear, the algorithm will sense from the accelerometer that the Az axes become more negative. If the hearing assistance device 105 is inserted in the left ear, the algorithm will sense from the accelerometer that the Az axes become more positive.

FIG. 2B shows the accelerometer axes inserted in the body frame for the pair of hearing assistance devices 105. The view is from behind head with the hearing assistance devices 105 inserted. The "body frame" is the frame of reference of the accelerometer body. Shown here is a presumed mounting orientation. Pin 1's are shown at the origins, with the Ay-axes parallel to the ground. In actual use, the Az vector will be tilted up or down to fit into ear canals, and the Axy vector may be randomly rotated about Az. These coordinate systems tilt and/or rotate relative to the fixed earth frame.

Figure 2C:
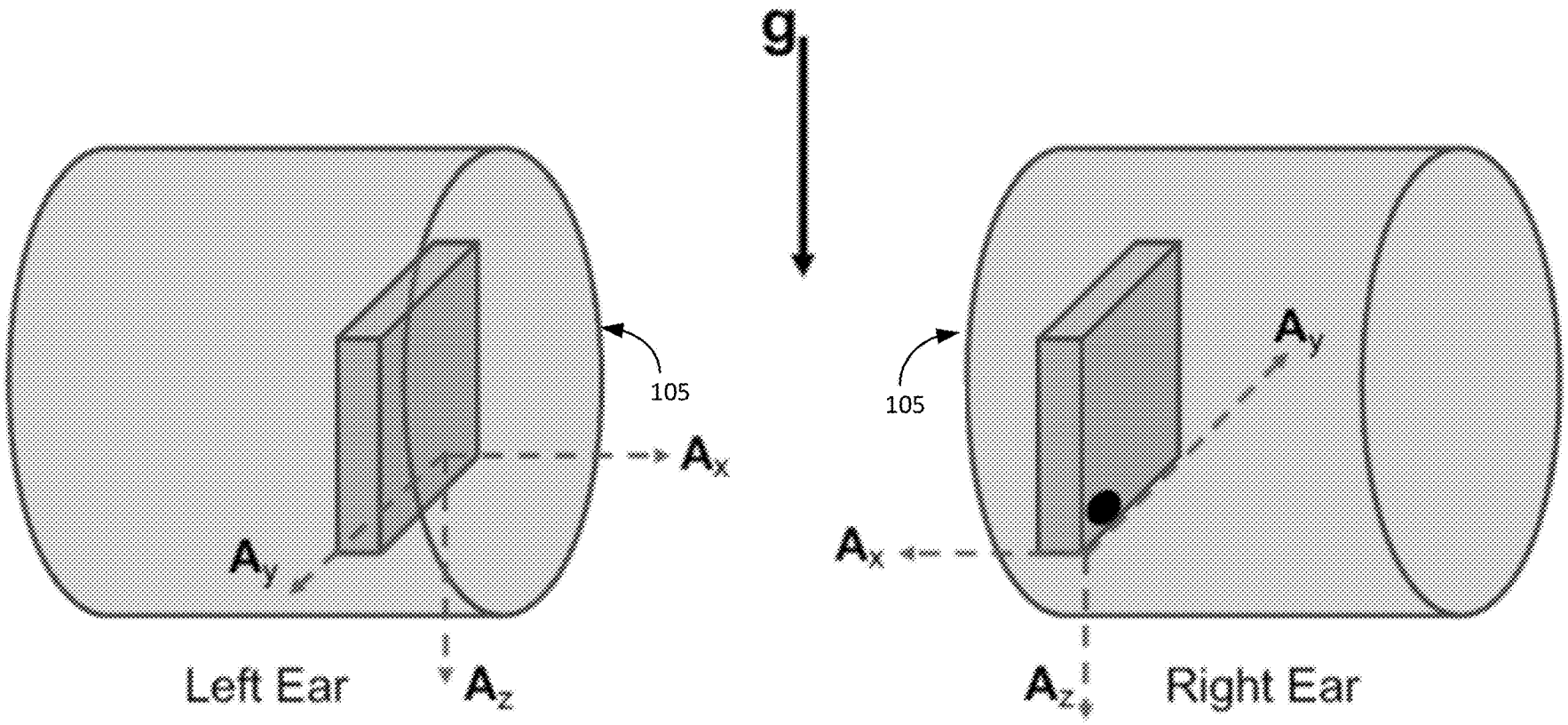
FIG. 2C illustrates an embodiment of a block diagram of an example pair of hearing assistance devices with their accelerometers and their axes relative to the earth frame and the gravity vector on those accelerometers.

FIG. 2C illustrates an embodiment of a block diagram of an example pair of hearing assistance devices 105 with their accelerometers and their axes relative to the earth frame and the gravity vector on those accelerometers. Again, viewing from the back of the head, the installed two hearing assistance devices 105 have a coordinate system with the accelerometers that is fixed relative to the earth ground because the gravity vector will generally be fairly constant. The coordinate system also shows three different vectors for the left and right accelerometers in the respective hearing assistance devices 105: Ay, Ax and Az. Az is always parallel to the gravity (g) vector. Axy is always parallel to the ground. The left/right determination module can use the gravity vector averaged over time into its determination of whether the hearing assistance device 105 is installed in the left or right ear of the user. After several samplings, the average of the gravity vector will remain relatively constant in magnitude and duration compared to each of the other plotted vectors. The time may be for a series of, an example of 3-7 samplings. However, the vectors from noise should vary from each other quite a bit.

Thus, the system may prompt the user move 1) forward, 2) backward and/or 3) tilt their head in a known pattern, and records the movement vectors coming from the accelerometer (See also FIGS. 9-12I). The user moves around with the hearing assistance devices 105 inserted in their ears. The accelerometer senses the forward backward, and/or tilt movement vectors and the gravity vector. The system via the signal processor may then compare theses recorded vector patterns to known vector patterns for the right ear and known vector patterns for the left ear. The known vector patterns for the right ear and known vector patterns for the left ear are established for the user population. The known vector patterns for the right ear at the known orientation are recorded for, for example moving forward, as well as recorded for, tilting the user's head. These accelerometer input patterns for moving forward and for tilting are repeatable. An algorithm can take in the vector variables and orientation coordinates obtained from the accelerometer to determine the current input patterns and compare this to the known vector patterns for the right ear and known vector patterns for the left ear to determine, which ear the hearing assistance device 105 is inserted in. The algorithm can use thresholds, if-then conditions, and other techniques to make this comparison to the known vector patterns. Overall, the accelerometer senses forward/backward/tilting movement vectors. Next, the DSP takes a few seconds to process the signal, determine Right and Left vector patterns to identify which device is located in which ear, and then load the Right and Left hearing profiles automatically.

Figure 1:
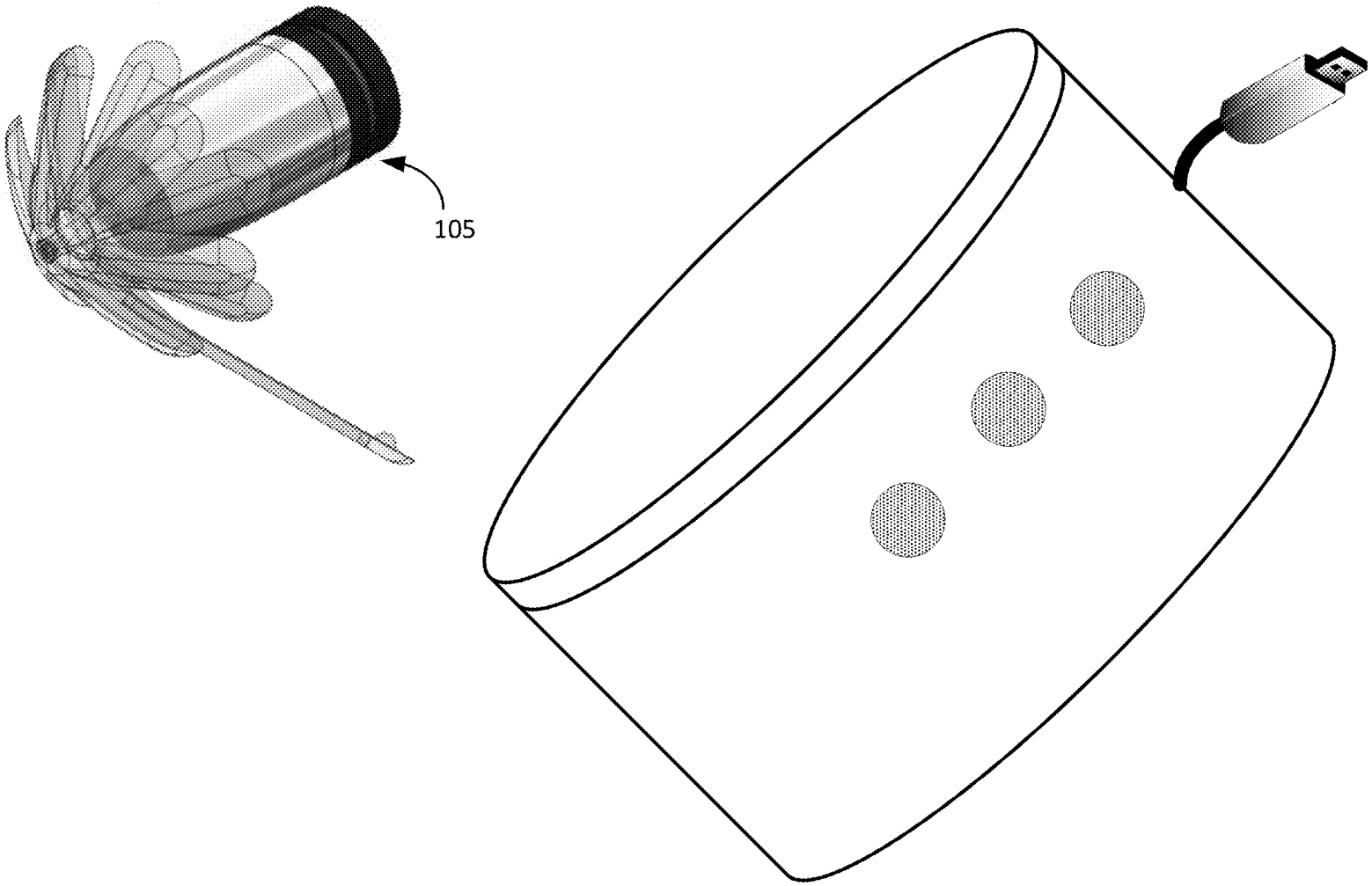
FIG. 1 Illustrates an embodiment of a block diagram of an example hearing assistance device cooperating with its electrical charger for that hearing assistance device.

In an embodiment, the user moves hearing assistance device 105 (e.g. takes the hearing assistance device 105 out of the charger, picks up the hearing assistance device 105 from table, etc.), powering on the hearing assistance device 105 (see FIG. 1). The user inserts the pair of hearing assistance devices 105 into their ears. Each hearing assistance device 105 uses the accelerometer to sense the current gravity vector. Each hearing assistance device 105 may normalize to the current gravity vector in this orientation of the hearing assistance device 105 in their ear. The user moves around and the accelerometer senses the forward/backward/tilting movement vectors. The processor of one or more of the hearing assistance devices 105 take a few seconds to process the signal, determine R/L, and then load the R/L hearing profiles automatically. The hearing assistance device 105 may then play a noise/voice prompt to notify the user that their profile is loaded.

Note, the hearing assistance device 105 powers on optionally with the last used sound profile, i.e. the sound profile for the right ear or the sound profile for the left ear. The algorithm receives the input vectors and coordinates information and then determines which ear that hearing assistance device 105 is inserted in. If the algorithm determines that the hearing assistance device 105 is currently inserted in the opposite ear than the last used sound profile, then the software loads the other ear's sound profile to determine the operation of that hearing assistance device 105. Each hearing assistance device 105 may have its own accelerometer. Alternatively, merely one hearing assistance device 105 of the pair may have its own accelerometer and utilize the algorithm to determine which ear that hearing assistance device 105 is inserted in. Next, that hearing assistance device 105 of the pair may then communicate wirelessly with the other hearing assistance device 105, potentially via a paired mobile phone, to load the appropriate sound profile into that hearing assistance device 105.

Ultimately, the user does not have to think about inserting the hearing assistance device 105 in the correct ear. Manufacturing does not need to apply external markings/coloring to each hearing assistance device 105, or track R/L SKUs for each hearing assistance device 105. Instead, a ubiquitous hearing assistance device 105 can be manufactured and inserted into both ears.

Figure 3:
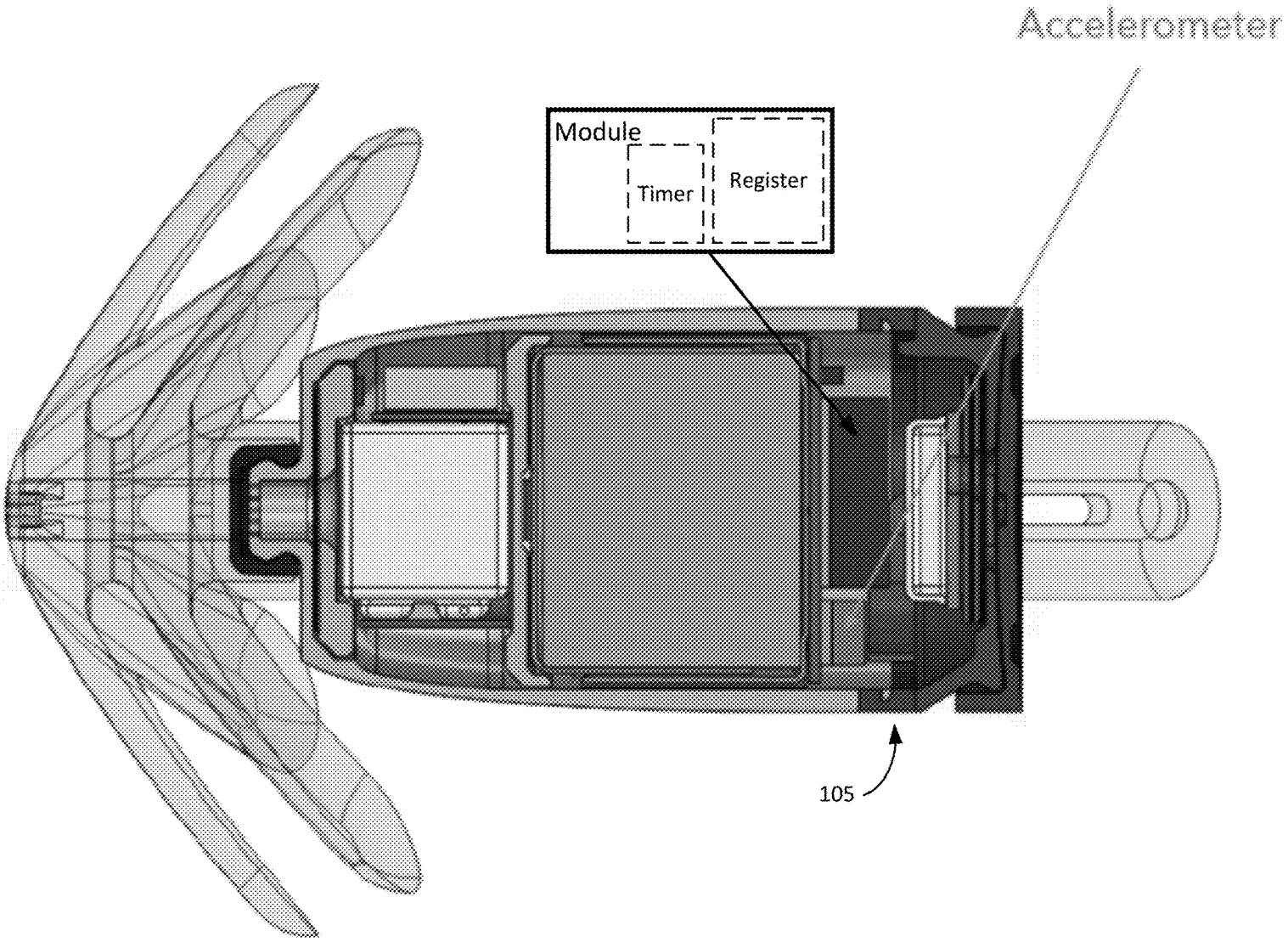
FIG. 3 illustrates an embodiment of a cutaway view of block diagram of an example hearing assistance device showing its accelerometer and left/right determination module with its various components, such as a timer, a register, etc. cooperating with that accelerometer.

FIG. 3 illustrates an embodiment of a cutaway view of block diagram of an example hearing assistance device 105 showing its accelerometer and left/right determination module with its various components, such as a timer, a register, etc. cooperating with that accelerometer. The left/right determination module may consist of executable instructions in a memory cooperating with one or more processors, hardware electronic components, or a combination of a portion made up of executable instructions and another portion made up of hardware electronic components.

The accelerometer is mounted to PCBA. The PCBA is assembled via adhesives/battery/receiver/dampeners to orient the accelerometer repeatably relative to the enclosure form.

Figure 5:
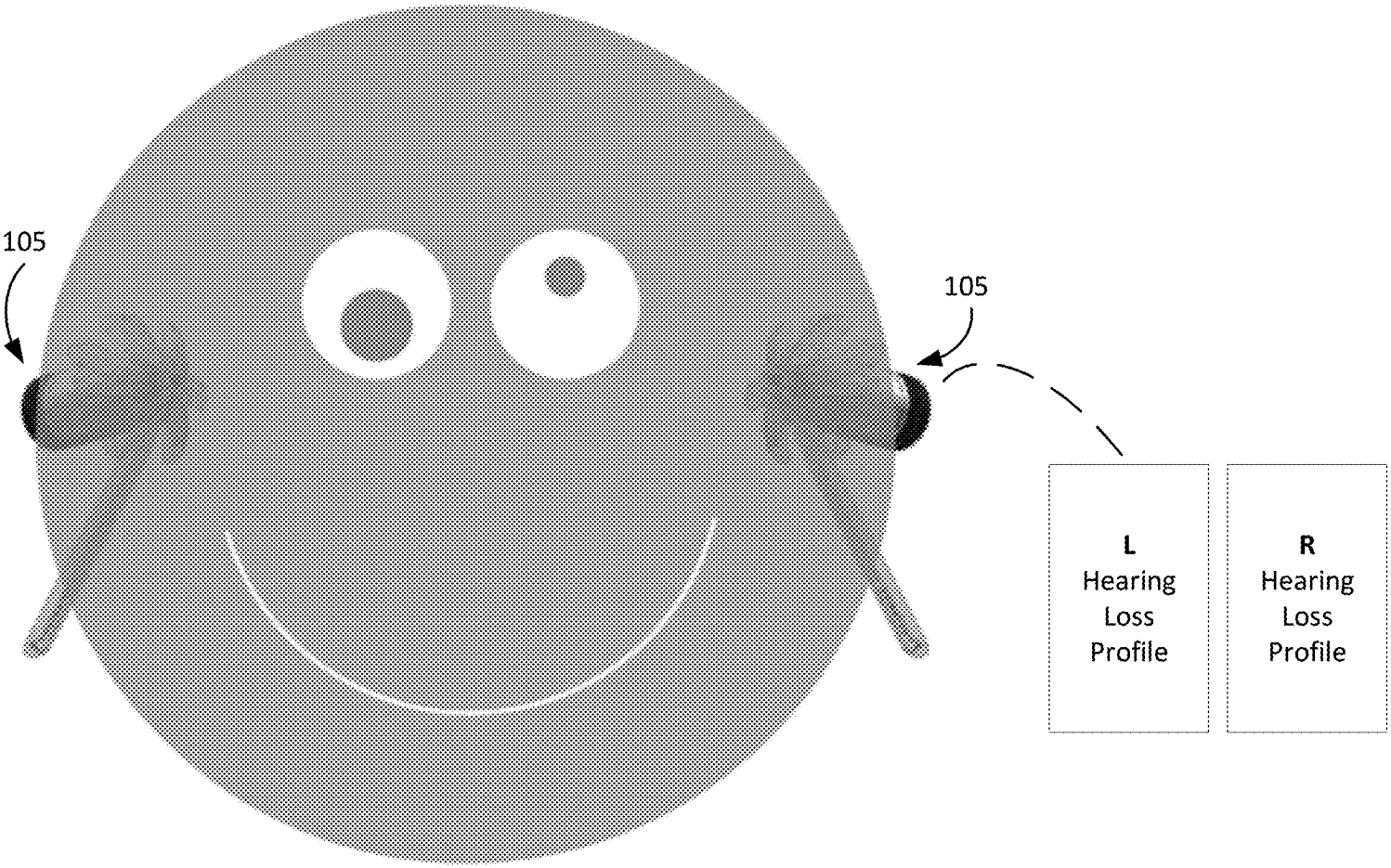
FIG. 5 illustrates an embodiment of a block diagram of example hearing assistance devices each with their own hearing loss profile and other audio configurations for the device including an amplification/volume control mode, a mute mode, two or more possible hearing loss profiles that can be loaded into that hearing assistance device, a play-pause mode, etc.

FIG. 5 illustrates an embodiment of a block diagram of example hearing assistance devices 105 each with their own hearing loss profile and other audio configurations for the device including an amplification/volume control mode, a mute mode, two or more possible hearing loss profiles that can be loaded into that hearing assistance device 105, a play-pause mode, etc. FIG. 5 also shows a vertical plane view of an example approximate orientation of a hearing assistance device 105 in a head. The user interface can cooperate with a left/right determination module. The left/right determination module can make a determination and recognize whether the hearing assistance device 105 is inserted and/or installed on a left side or right side of a user. The user interface can receive the control signals as sensed by the accelerometers to trigger an autonomous loading of the hearing loss profile corresponding to the left or right ear based on the determination made by the left/right determination module.

Figure 6:
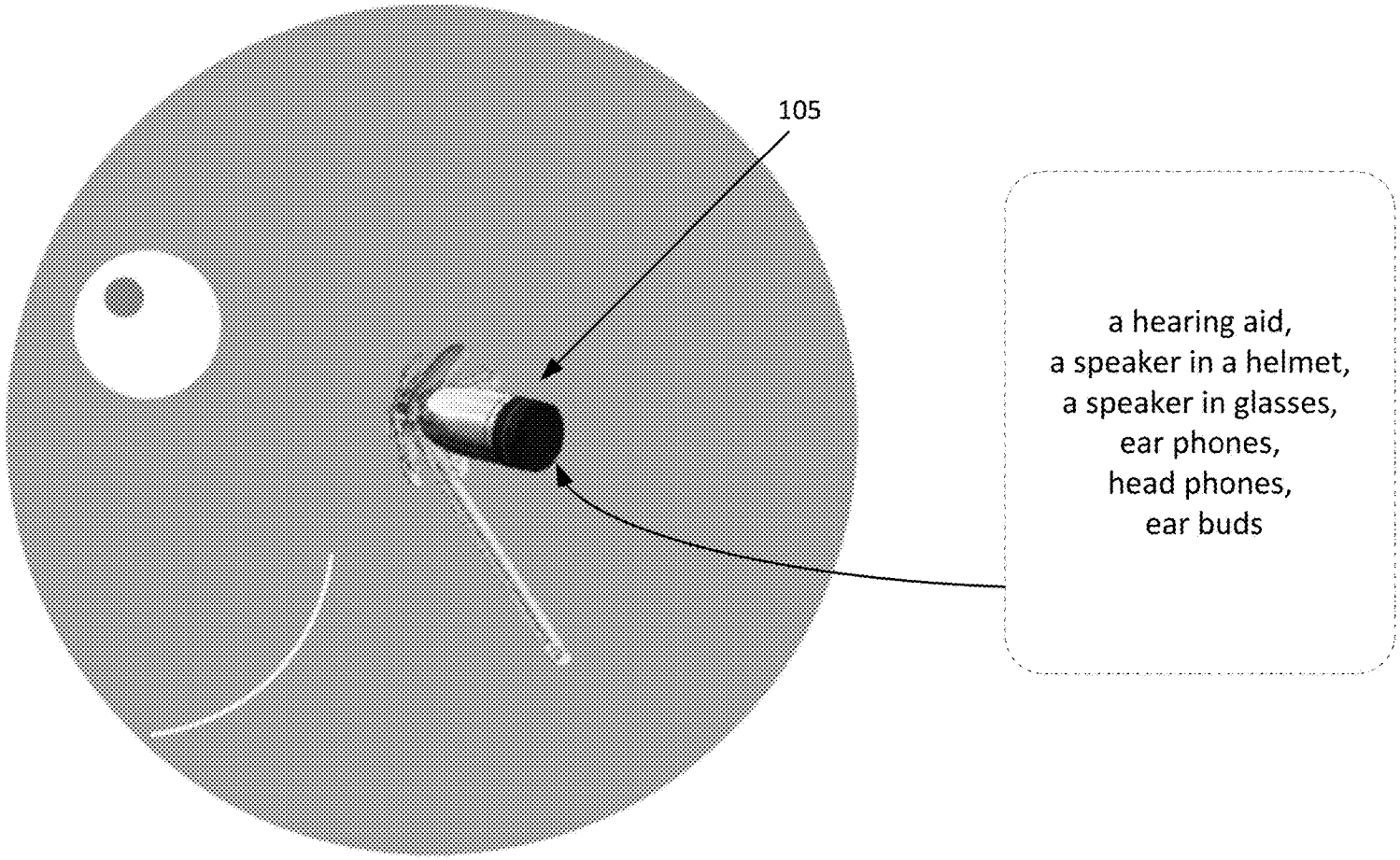
FIG. 6 illustrates an embodiment of a block diagram of an example hearing assistance device, such as a hearing aid or an ear bud.

FIG. 6 illustrates an embodiment of a block diagram of an example hearing assistance device 105, such as a hearing aid or an ear bud. The hearing assistance device 105 can take a form of a hearing aid, an ear bud, earphones, headphones, a speaker in a helmet, a speaker in glasses, etc. FIG. 6 also shows a side view of an example approximate orientation of a hearing assistance device 105 in the head. Again, the form of the hearing assistance device 105 can be implemented in a device such as a hearing aid, a speaker in a helmet, a speaker in a glasses, a smart watch, a smart phone, ear phones, head phones, or ear buds.

Figure 7A:
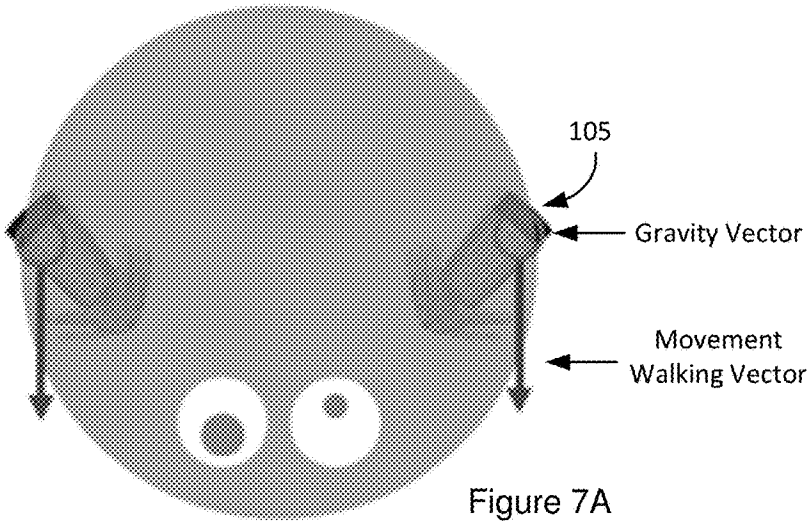
FIGS. 7A-7C illustrate an embodiment of a block diagram of an example hearing assistance device with three different views of the hearing assistance device installed.
Figure 7B:
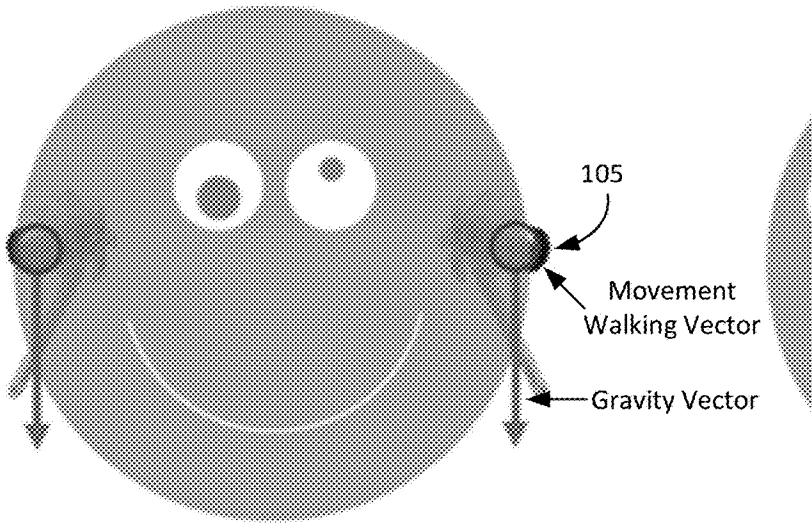
Figure 7C:
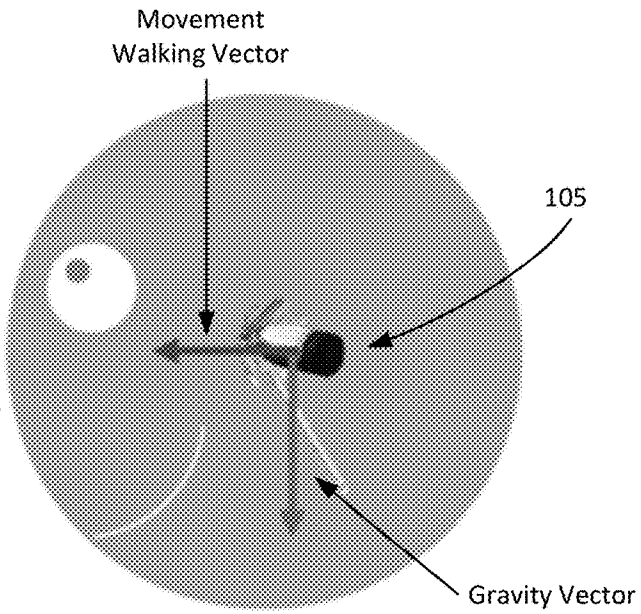

FIGS. 7A-7C illustrate an embodiment of a block diagram of an example hearing assistance device 105 with three different views of the hearing assistance device 105 installed. The top left view FIG. 7A is a top-down view showing arrows with the vectors from movement, such as walking forwards or backwards, coming from the accelerometers in those hearing assistance devices 105. FIG. 7A also shows circles for the vectors from gravity coming from the accelerometers in those hearing assistance devices 105. The bottom left view FIG. 7B shows the vertical plane view of the user's head with circles showing the vectors for movement as well as downward arrows showing the gravity vector coming from the accelerometers in those hearing assistance devices 105. The bottom right view FIG. 7C shows the side view of the user's head with a horizontal arrow representing a movement vector and a downward arrow reflecting a gravity vector coming from the accelerometers in those hearing assistance devices 105.

FIGS. 7A-7C thus show multiple views of an example approximate orientation of a hearing assistance device 105 in a head. The GREEN arrow indicates the gravity vector when the hearing assistance device 105 is inserted in the ear canal. The RED arrow indicates the walking forwards & backwards vector when the hearing assistance device 105 is inserted in the ear canal.

Figure 8:
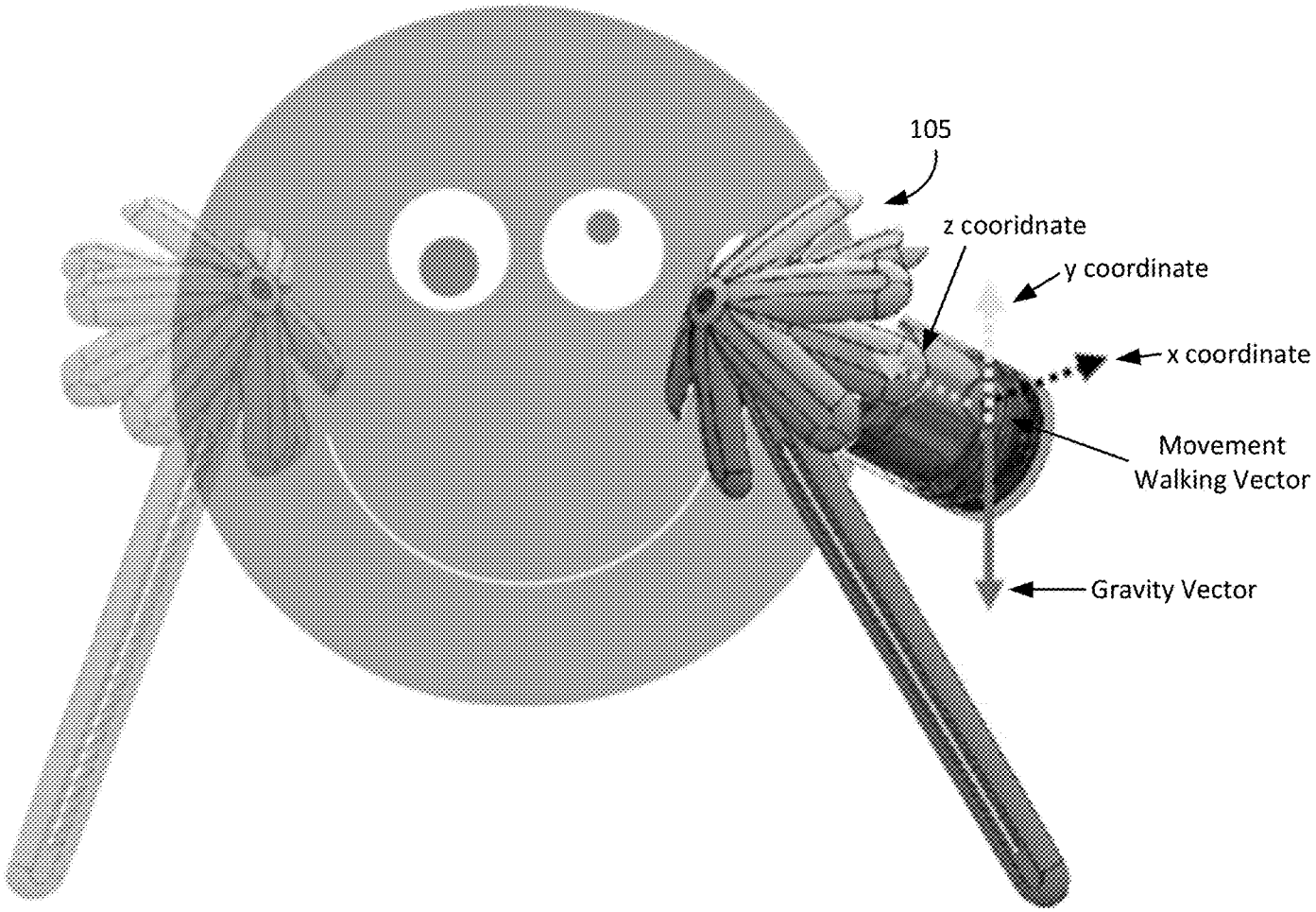
FIG. 8 shows a view of an example approximate orientation of a hearing assistance device in a head with its removal thread beneath the location of the accelerometer and extending downward on the head.

FIG. 8 shows a view of an example approximate orientation of a hearing assistance device 105 in a head with its removal thread beneath the location of the accelerometer and extending downward on the head. The GREEN arrow indicates the gravity vector when the hearing assistance device 105 is inserted in the ear canal. The GREEN arrow indicates the gravity vector that generally goes in a downward direction. The RED circle indicates the walking forwards & backwards vector when the hearing assistance device 105 is inserted in the ear canal. The yellow, black, and blue arrows indicate the X, Y, and Z coordinates when the hearing assistance device 105 is inserted in the ear canal. The Z coordinate is the blue arrow. The Z coordinate is the blue arrow that goes relatively horizontal. The X coordinate is the black arrow. The Y coordinate is the yellow arrow. The yellow and black arrows are locked at 90 degrees to each other.

Figure 9:
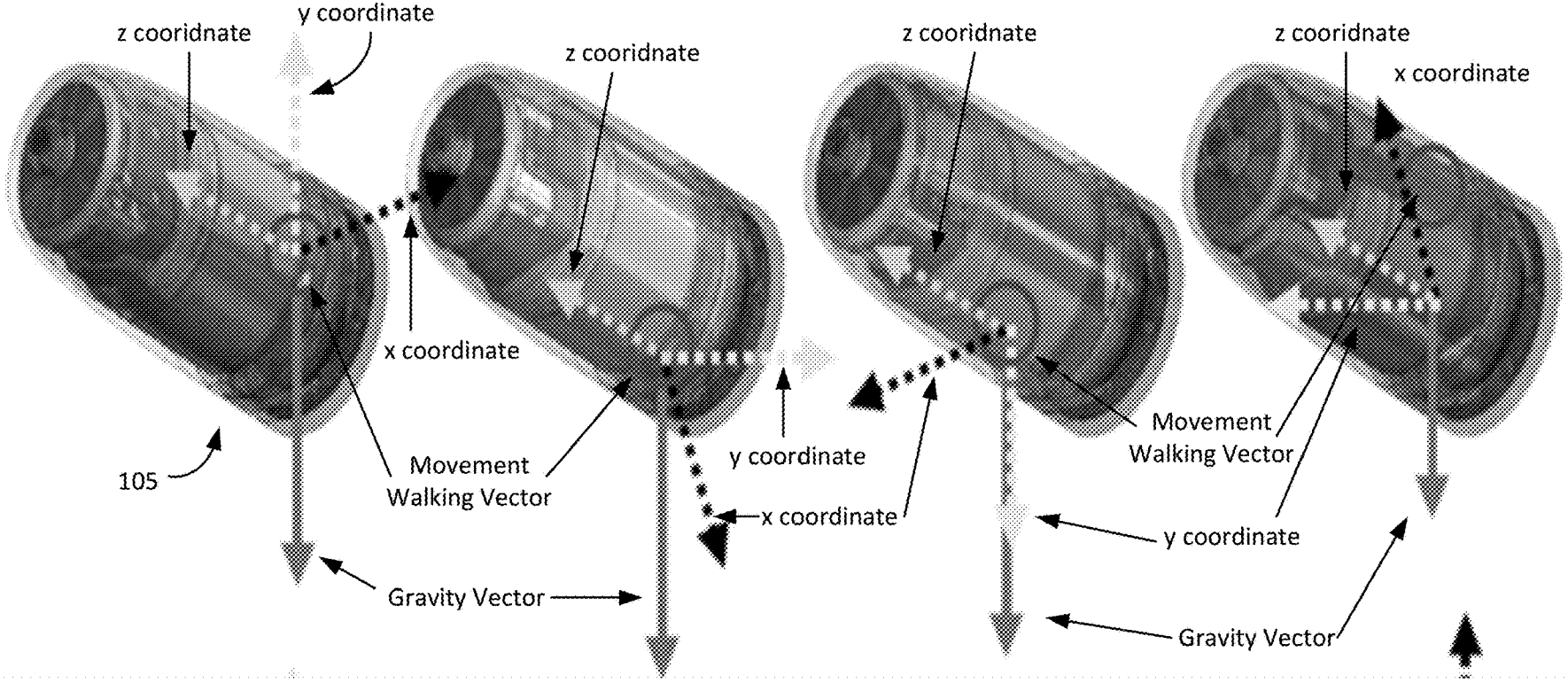
FIG. 9 shows an isometric view of the hearing assistance device inserted in the ear canal.

FIG. 9 shows an isometric view of the hearing assistance device 105 inserted in the ear canal. Each image of the hearing assistance device 105 with the accelerometer is shown with a 90-degree rotation of the hearing assistance device 105 from the previous image. The GREEN arrow indicates the gravity vector when the hearing assistance device 105 is inserted in the ear canal. The GREEN arrow indicates the gravity vector that generally goes in a downward direction. The RED circle indicates the walking forwards & backwards vector when the hearing assistance device 105 is inserted in the ear canal. The yellow, black, and blue arrows indicate the X, Y, and Z coordinates when the hearing assistance device 105 is inserted in the ear canal. The Z coordinate is the blue arrow that goes relatively horizontal. The X coordinate is the black arrow. The Y coordinate is the yellow arrow. The yellow and black arrows are locked at 90 degree to each other.

Figure 10:
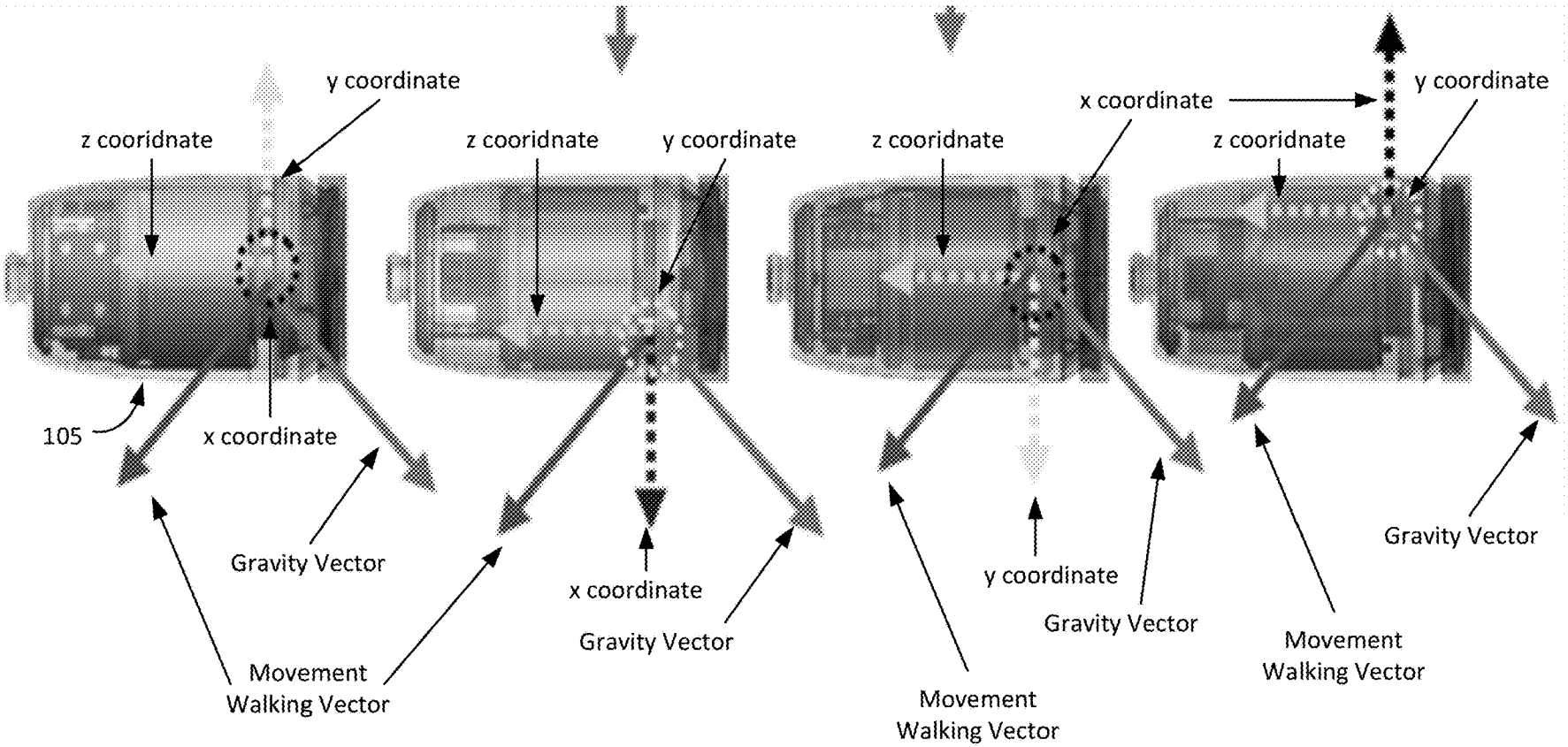
FIG. 10 shows a side view of the hearing assistance device inserted in the ear canal.

FIG. 10 shows a side view of the hearing assistance device 105 inserted in the ear canal. Each image of the hearing assistance device 105 with the accelerometer is shown with a 90-degree rotation of the hearing assistance device 105 from the previous image. The GREEN arrow indicates the gravity vector when the hearing assistance device 105 is inserted in the ear canal. The GREEN arrow indicates the gravity vector that generally goes in a downward direction. The RED arrow indicates the walking forwards & backwards vector when the hearing assistance device 105 is inserted in the ear canal. The RED arrow indicates the walking forwards & backwards vector that generally goes in a downward and to the left direction. The yellow, black, and blue arrows indicate the X, Y, and Z coordinates when the hearing assistance device 105 is inserted in the ear canal. The Z coordinate is the blue arrow that goes relatively horizontal.

Figure 11:
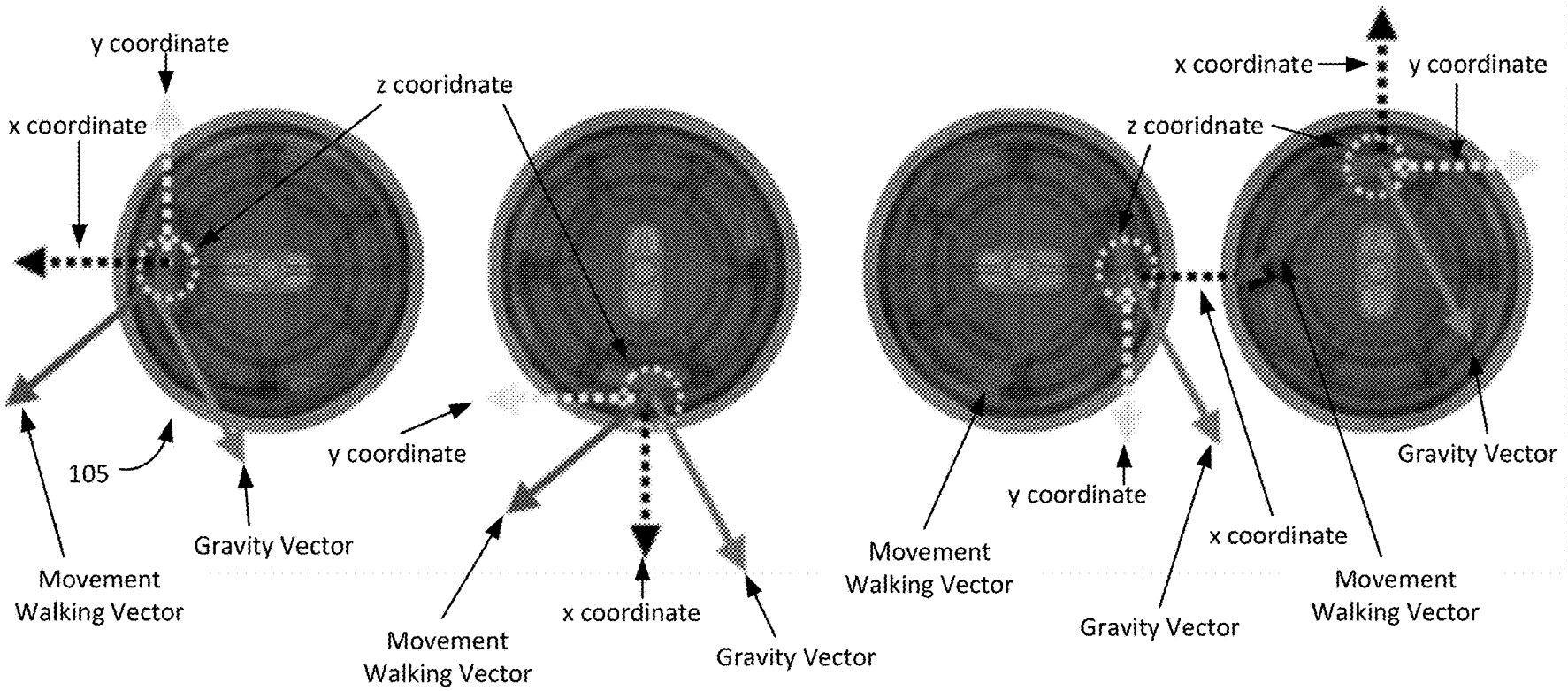
FIG. 11 shows a back view of the hearing assistance device inserted in the ear canal.

FIG. 11 shows a back view of the hearing assistance device 105 inserted in the ear canal. Each image of the hearing assistance device 105 with the accelerometer is shown with a 90-degree rotation of the hearing assistance device 105 from the previous image. The GREEN arrow indicates the gravity vector when the hearing assistance device 105 is inserted in the ear canal. The GREEN arrow indicates the gravity vector that generally goes in a downward direction. The RED arrow indicates the walking forwards & backwards vector when the hearing assistance device 105 is inserted in the ear canal. The RED arrow indicates the walking forwards & backwards vector that generally goes in a downward and to the left direction. The yellow, black, and blue arrows indicate the X, Y, and Z coordinates when the hearing assistance device 105 is inserted in the ear canal. The Z coordinate is the blue circle. The yellow and black arrows are locked at 90 degree to each other.

The algorithm can take in the vector variables and orientation coordinates obtained from the accelerometer to determine the current input patterns and compare this to the known vector patterns for the right ear and known vector patterns for the left ear to determine which ear the hearing assistance device 105 is inserted in.

FIG. 8 shows a view of an example approximate orientation of a hearing assistance device 105 in a head with its removal thread beneath the location of the accelerometer and extending downward on the head.

Tap Controls on the Hearing Assistance Device

A user interface may control a hearing assistance device 105 via use of an accelerometer and a left/right determination module to detect tap controls on the device from a user. The user may manually change a sound profile on the hearing assistance device 105 while the hearing assistance device 105 is still in the ear (using in-ear hardware), easily and discreetly. The left/right determination module may act to autonomously detect and load the correct left or right hearing loss sound profile upon recognizing whether this hearing assistance device 105 is installed on the left side or the right side.

The hearing assistance device 105 may use a sensor combination of an accelerometer, a microphone, a signal processor, and a capacitive pad to change sound profiles easily and discreetly, activated by one or more "finger tap" gestures around the hearing assistance device 105 area. This finger tap gesture could be embodied as a tap to the mastoid, ear lobe, or to the device itself. For example, the user may finger tap on the removal pull-tab thread of the hearing assistance device 105 (See FIG. 8). In theory, this should make the device less prone to false-triggers of manual sound profile changes. The example "tap" gesture, is discussed but any type of "gesture" sensed by a combination of an accelerometer, a microphone, and a capacitive pad could be used.

The sensor combination of an accelerometer, a microphone, and a capacitive pad all cooperate together to detect the finger tap pattern via sound, detected vibration/acceleration, and change in capacitance when the finger tap gesture occurs. Threshold amount for each of these parameters may be set and, for example, two out of three need to be satisfied in order to detect a proper finger tap. In an embodiment, the hearing assistance device 105 may potentially have any sensor combination of signal inputs from the accelerometer, the microphone, and the capacitive pad to prompt the sound profile change. The accelerometer, the microphone, and the capacitive pad may mount to a flexible PCBA circuit, along with a digital signal processor configured for converting input signals into program changes (See FIG. 13). All of these sensors are assembled in a known orientation relative to the hearing assistance device 105. The hearing assistance device's outer form is designed such that it is assembled into the ear canal with a repeatable orientation relative to the head coordinate system, and the microphone and capacitive pad face out of the ear canal.

An example tap detection algorithm may be configured to recognize the tap signature. A tap of the head, with a partly cupped hand over the ear, or a tap on the mastoid process, unfolds over a few hundred milliseconds. These signatures from the sensors can be repeatable within certain thresholds. For example, the tap detection algorithm may detect the slow storage of energy in the flexi-fingers then a quick rebound, (e.g. a sharp ~10 ms spike in acceleration) after every tap. The tap detection algorithm may use detected signals such as this negative spike with a short time width, which can be the easiest to detect indicator. Additionally, other unique patterns can indicate a tap such as a low frequency acceleration to the right followed by a rebound.

Filters can be built in to detect, for example, the typical output from the accelerometer when the user is walking, dancing, chewing, or running. These sets of known patterns can be used to establish the detection of the tapping gesture by the user. See FIGS. 12A-12I for example known signal responses to different environmental situations and the sensor's response data.

Figure 12A:
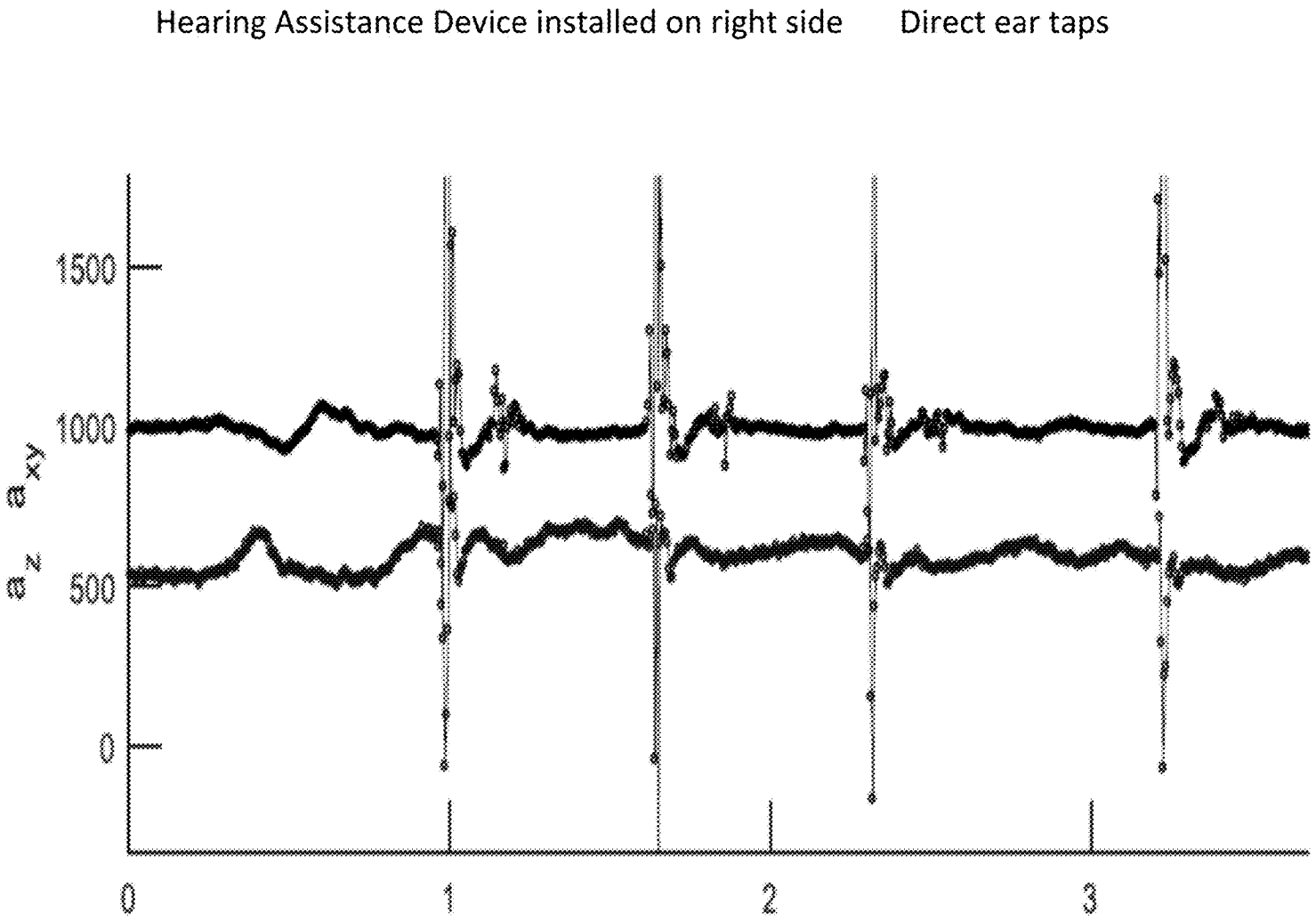
FIGS. 12A-12I illustrate an embodiment of graphs of vectors as sensed by one or more accelerometers mounted in example hearing assistance device.

FIG. 12A illustrates an embodiment of a graph of vectors as sensed by one or more accelerometers mounted in example hearing assistance device 105. The graph may vertically plot the magnitude, such an example scale 0 to 1500, and horizontally plot time, such as 0-3 units of time. In this example, the hearing assistance device 105 is installed in a right ear of the user and that user is taking a set of user actions of tapping on the right ear, which has the hearing assistance device 105 installed in that ear. Shown for the top response plotted on the graph is the Axy vector. The graph below the top graph is the response for the Az vector. With the device in the right ear, tapping on the right should induce a positive Az bump on the order of a few hundred milliseconds. However in this instance, the plotted graph shows a negative high-frequency spot spike with a width on the order of around 10 milliseconds. In both cases, they both have significant changes in magnitude due to the tap being on the corresponding side where the hearing assistance device 105 is installed. In this case of the negative spike from the tap, it is thought that the tap also slowly stores elastic energy in the flexible fingers/petals, which is then released quickly in a rebound that is showing up on the plotted vectors. The user actions of the taps may be performed as a sequence of taps with an amount of taps and a specific cadence to that sequence.

The user interface, the one or more accelerometers, and the left/right determination module can cooperate to determine whether the hearing assistance device 105 is inserted and/or installed on a left side or right side of a user via an analysis of a current set of vectors of orientation sensed by the accelerometers when the user taps a known side of their head and any combination of a resulting i) magnitude of the vectors, ii) an amount of taps and a corresponding amount of spikes in the vectors, and iii) a frequency cadence of a series of taps and how the vectors correspond to a timing of the cadence (See FIGS. 12A-12I).

Also, the left/right determination module can compare magnitudes and amount of taps for left or right to a statistically set magnitude threshold to test if the magnitude tap is equal to or above that set fixed threshold to qualify as a secondary factor to verify which ear the hearing aid is in.

Figure 12B:
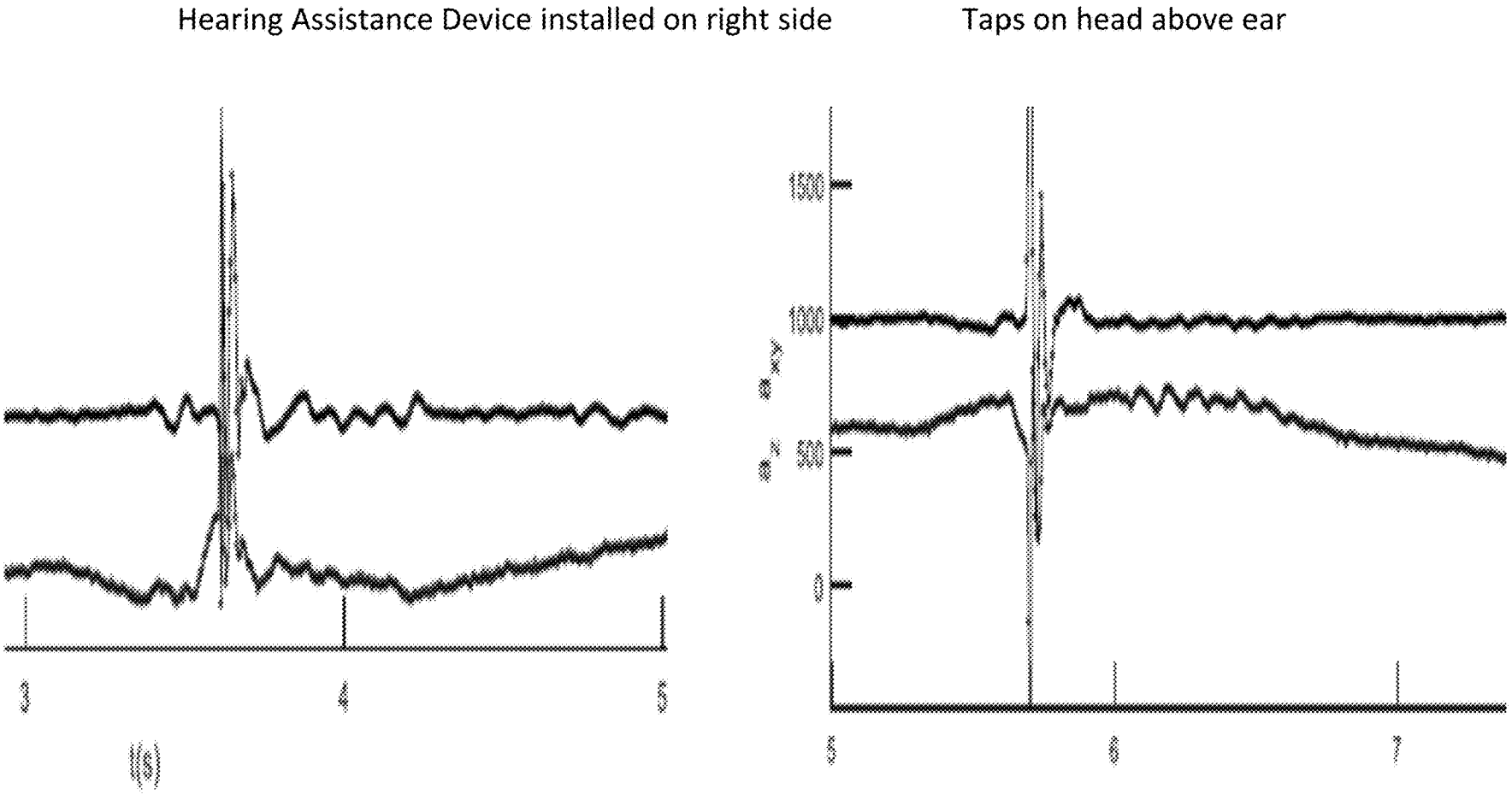

FIG. 12B illustrates an embodiment of a graph of vectors of an example hearing assistance device 105. The graph may vertically plot the magnitude, such an example scale 0 to 1500, and horizontally plot time, such as 3-5 and 5-7 units of time. In this example, the hearing assistance device 105 is installed in a right ear of the user and that user is taking a set of user actions of tapping very hard on their head above the ear, initially on left side and then on the right side. The graphs shows the vectors for Az and Axy from the accelerometer. The graph on the left with the hearing assistance device 105 installed in the right ear has the taps occurring on the left side of the head. The taps on the left side of the head cause a low-frequency acceleration to the right file via rebound. This causes a broad dip and recovery from three seconds to five seconds. There is a hump and a sharp peek at around 3.6 seconds in which the device is moving to the left. The graph on the right shows a tap on the right side of the head with the hearing assistance device 105 installed in the right ear. Tapping on the right side of the head causes a low frequency acceleration to the left followed by a rebound; as opposed to an acceleration to the right resulting from a left side tap. This causes a broad pump recovery from 5 to 7 seconds there is a dip and a sharp peek at around 5.7 seconds which is the device moving to the right.

Figure 12C:
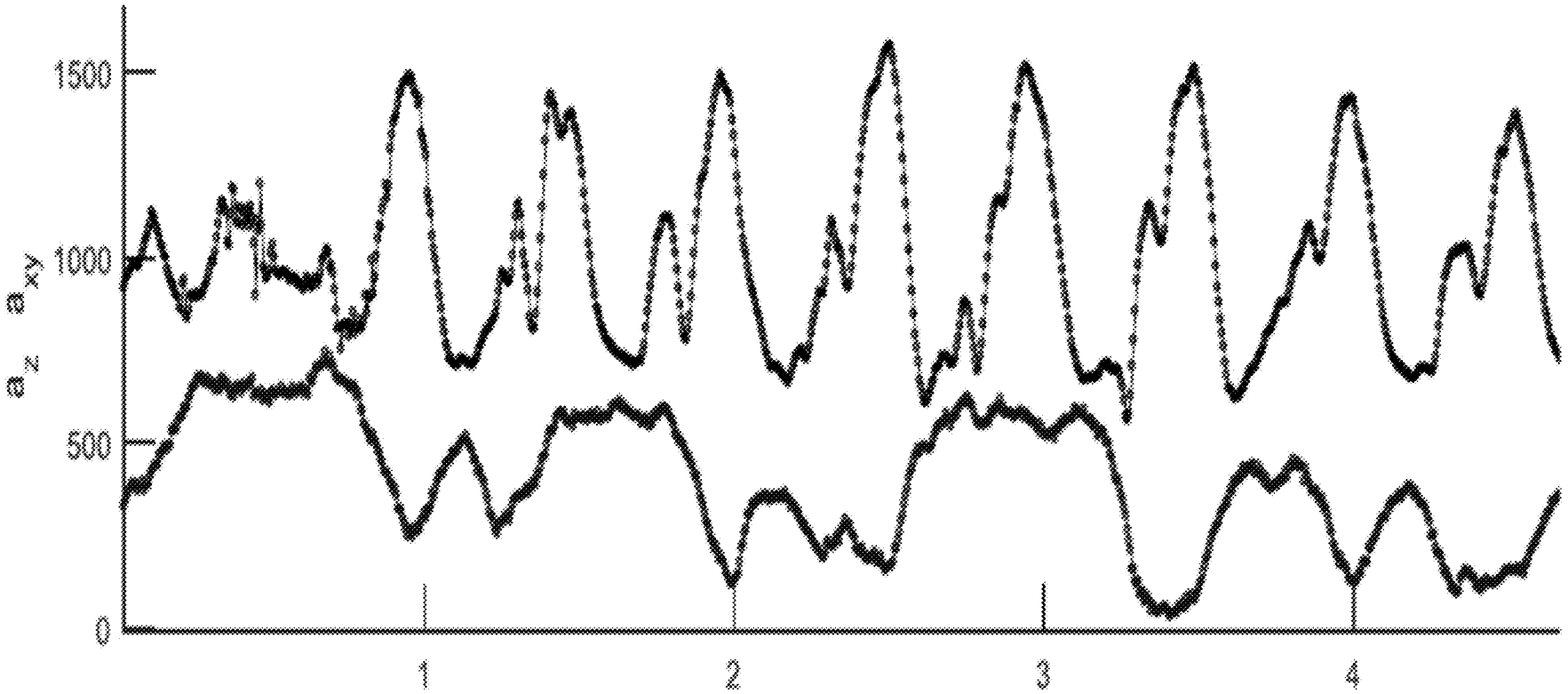

FIG. 12C illustrates an embodiment of a graph of vectors of an example hearing assistance device 105. The graph may vertically plot the magnitude, such an example scale 0 to 1500, and horizontally plot time, such as 0-5 units of time. The graph shows the vectors for Az and Axy from the accelerometer. In this example, the hearing assistance device 105 is installed in a right ear of the user and that user is taking a set of user actions of simply walking in place. The vectors coming from the accelerometer contain a large amount of low-frequency components. The plotted jiggles below 1 second are from the beginning to hold the wire still against the head. By estimation, the highest frequency components from walking in place maybe around 10 Hz. The graphs so far, 12A-12C, show that different user activities can have very distinctive characteristics from each other.

Figure 12D:
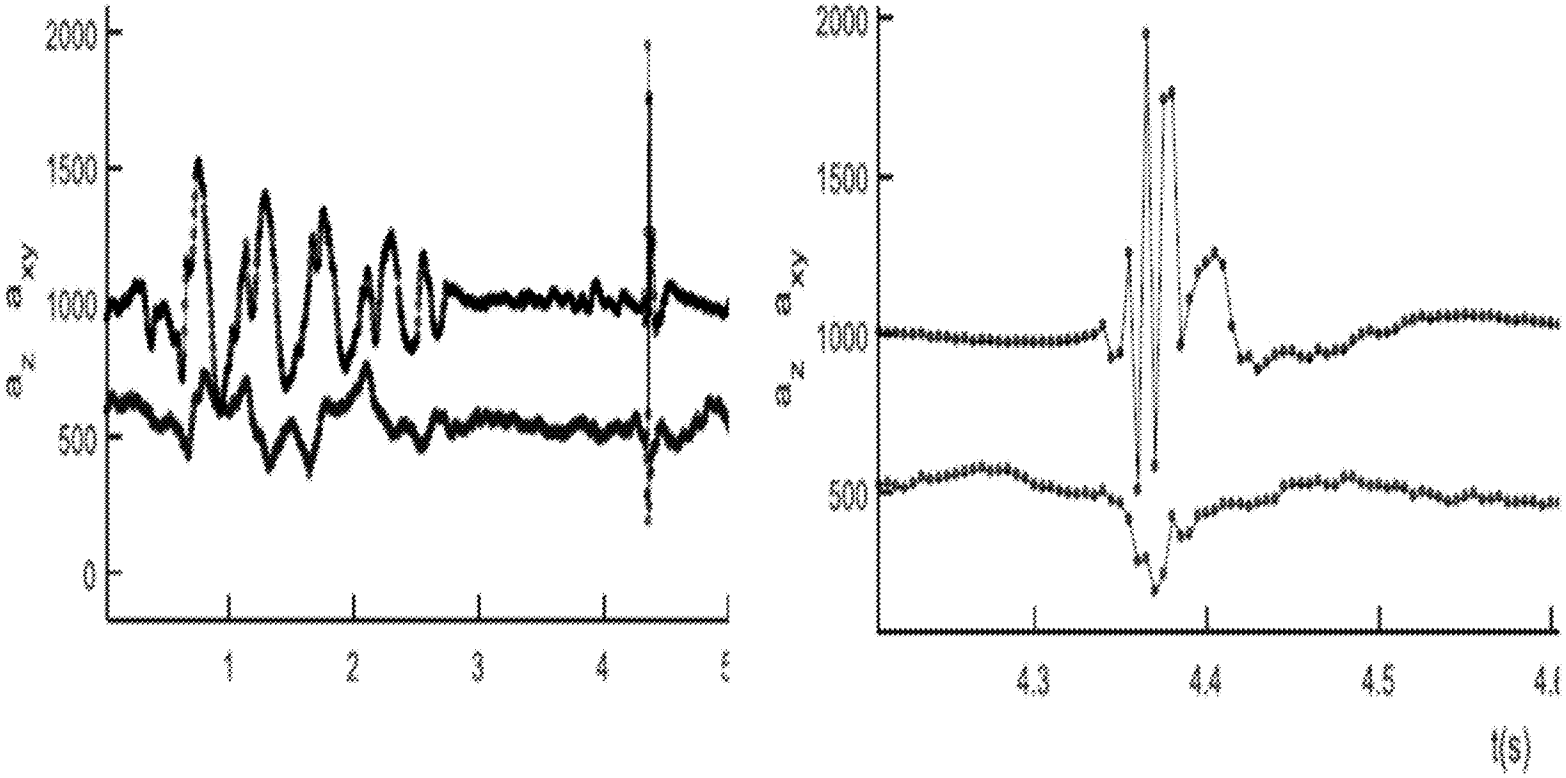

FIG. 12D illustrates an embodiment of a graph of vectors of an example hearing assistance device 105. The graph may vertically plot the magnitude, such an example scale 0 to 2000, and horizontally plot time, such as 0-5 units of time. The graph shows the vectors for Az and Axy from the accelerometer. In this example, the hearing assistance device 105 is installed in a right ear of the user and that user is taking a set of user actions of walking in a known direction and then stopping to tap on the right ear. The graph on the left shows that the tapping on the ear has a positive low-frequency bump, as expected, just before 4.3 seconds. However, this bump is not particularly distinct from other low-frequency signals by itself. However, in combination at about 4.37 seconds we see the very distinct high-frequency rebound that has a large magnitude. The graph on the right is an expanded view from 4.2 to 4.6 seconds.

The user actions causing control signals as sensed by the accelerometers can be a sequence of one or more taps to initiate the determination of which ear the hearing assistance device 105 is inserted in and then the user interface prompts the user to do another set of user actions such as move their head in a known direction so the vectors coming out of the one or more accelerometers can be checked against an expected set of vectors when the hearing assistance device 105 is moved in that known direction.

Figure 12E:
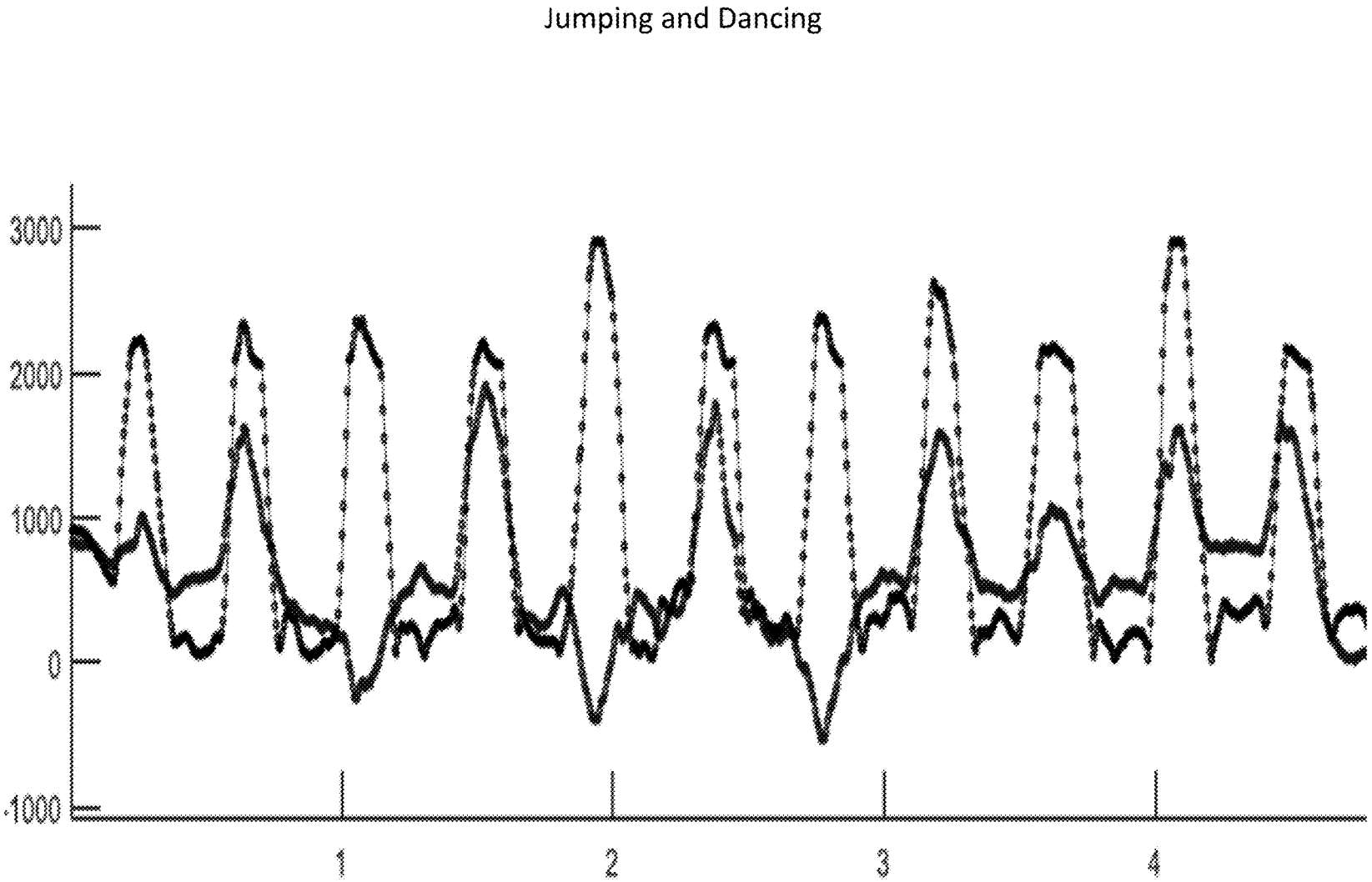

FIG. 12E illustrates an embodiment of a graph of vectors of an example hearing assistance device 105. The graph may vertically plot the magnitude, such an example scale 0 to 3000, and horizontally plot time, such as 0-5 units of time. The graph shows the vectors for Az and Axy from the accelerometer. In this example, the hearing assistance device 105 is installed in a right ear of the user and that user is taking a set of user actions of jumping and dancing. What can be discerned from the plotted graphs is user activities, such as walking, jumping, dancing, may have some typical characteristics. However, these routine activities definitely do not result in the high-frequency spikes with their rebound oscillations seen when a tap on the head occurs.

Figure 12F:
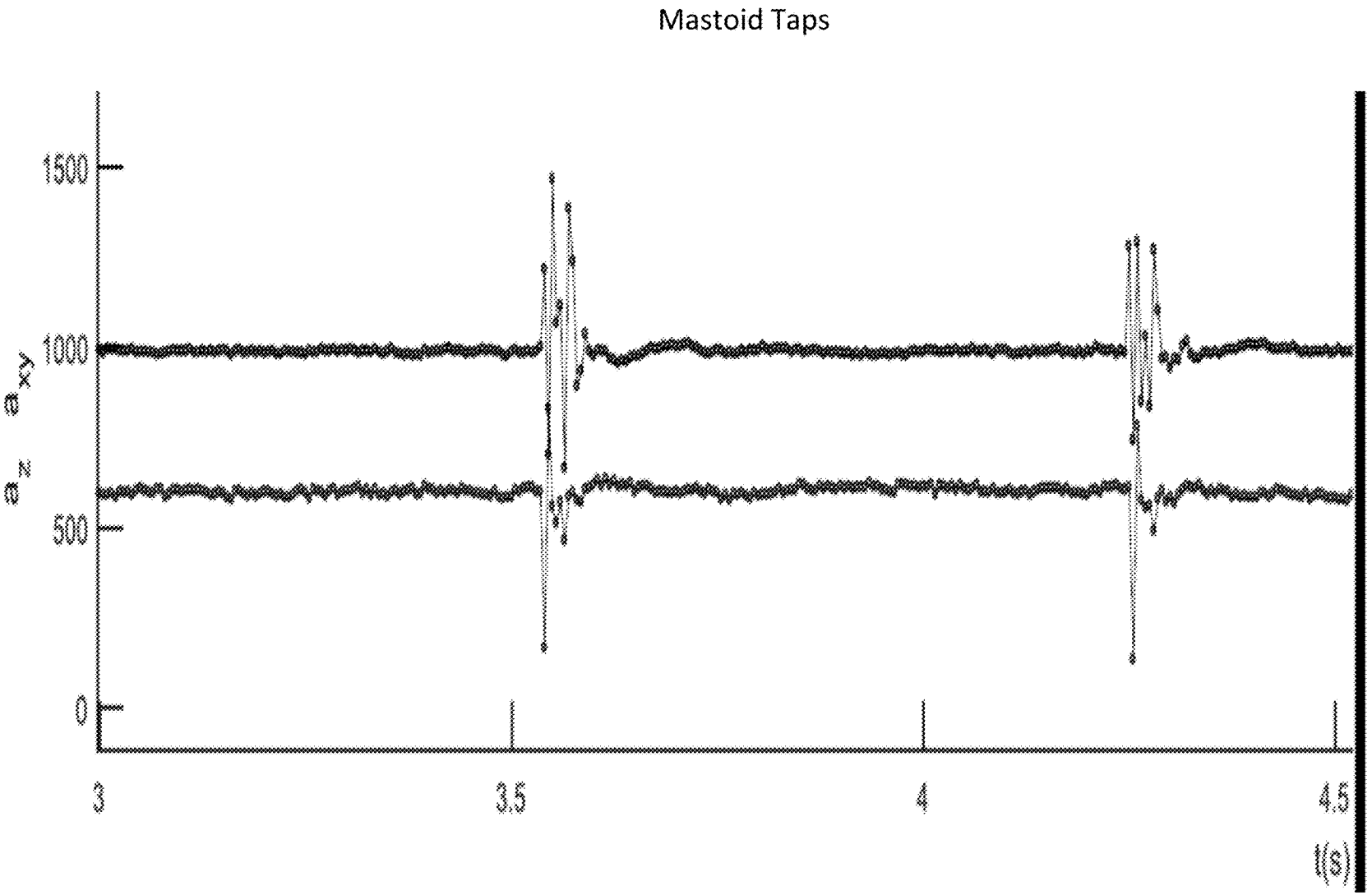

FIG. 12F illustrates an embodiment of a graph of vectors of an example hearing assistance device 105. The graph may vertically plot the magnitude, such an example scale 0 to 1500, and horizontally plot time, such as 0-5 units of time. The graph shows the vectors for Az and AXY from the accelerometer. In this example, the hearing assistance device 105 is installed in a right ear of the user and that user is taking a set of user actions of tapping on their mastoid part of the temporal bone. The graph shows, just like taps directly on the ear, taps on the mastoid bone on the same side as the installed hearing assistance device 105 should go slightly positive. However, we do not see that here perhaps because the effect is smaller tapping on the mastoid or the flexi-fingers/petals of the hearing assistance device 105 act as a shock absorber. Nonetheless, we do see a sharp spike that is initially highly negative in magnitude. Contrast this with the contralateral taps shown in the graph of FIG. 12G, which initially go highly positive with the spike. Nevertheless, generalizing this information to all taps, whether they be directly on the ear or on other portions of the user's head, the initial spike pattern of a tap might act as a telltale sign of vectors coming out of the accelerometer due to a tap. Thus, a user action such as a tap can help in identifying which side a hearing assistance device 105 in installed on as well as being a discernable action to control an audio configuration of the device.

Figure 12G:
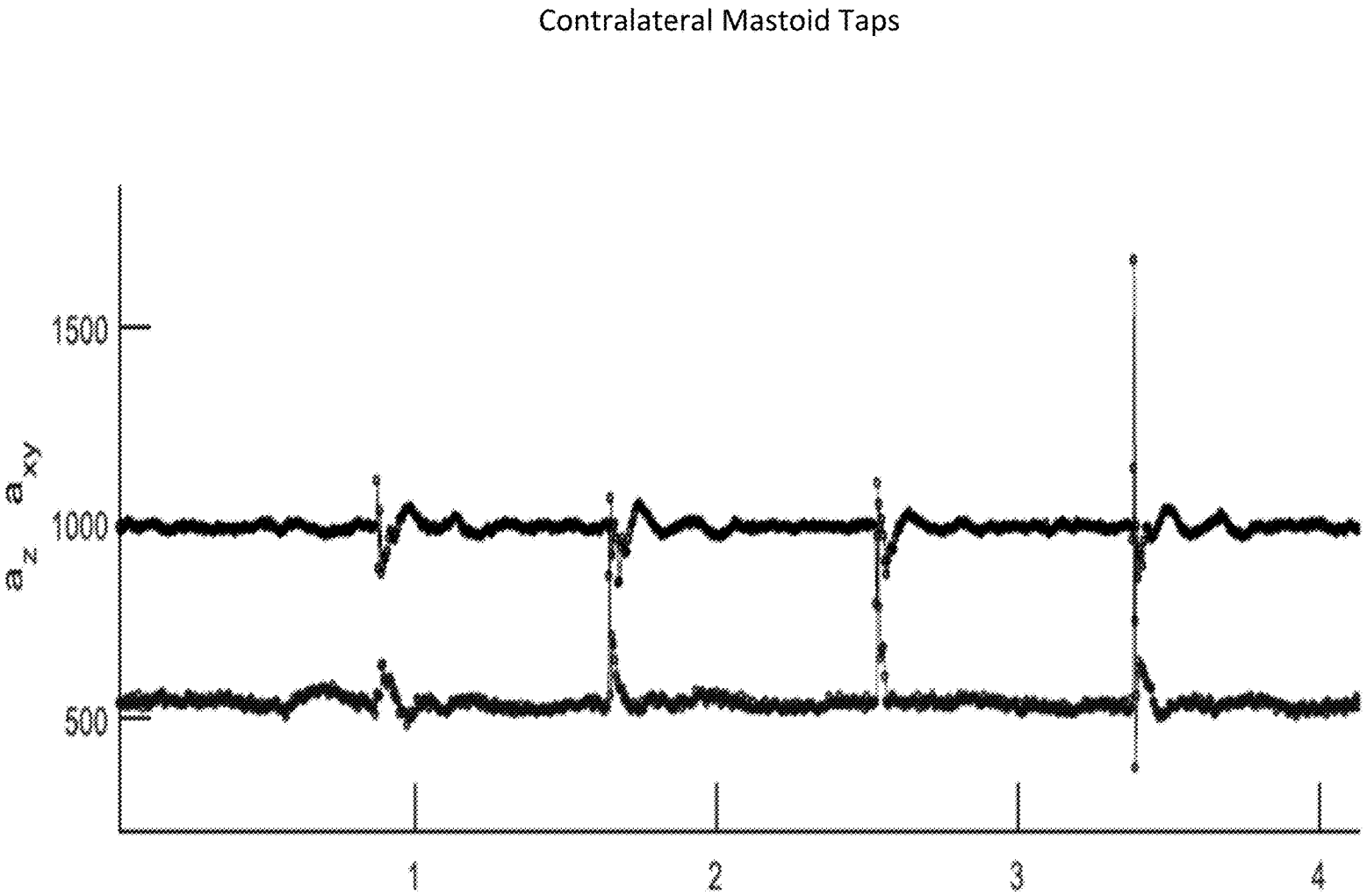

FIG. 12G illustrates an embodiment of a graph of vectors of an example hearing assistance device 105. The graph may vertically plot the magnitude, such an example scale 0 to 1500, and horizontally plot time, such as 0-4 units of time. The graph shows the vectors for Az and AXY from the accelerometer. In this example, the hearing assistance device 105 is installed in a right ear of the user and that user is taking a set of user actions of contralateral taps on the mastoid. The taps occur on the opposite side of where the hearing assistance device 105 is installed. Taps on the left mastoid again show a sharp spike that is initially highly positive. Thus, by looking at initial sign of the sharp peak and its characteristics, we can tell if the taps were on the same side of the head as the installed hearing assistance device 105 or on the opposite side.

Figure 12H:
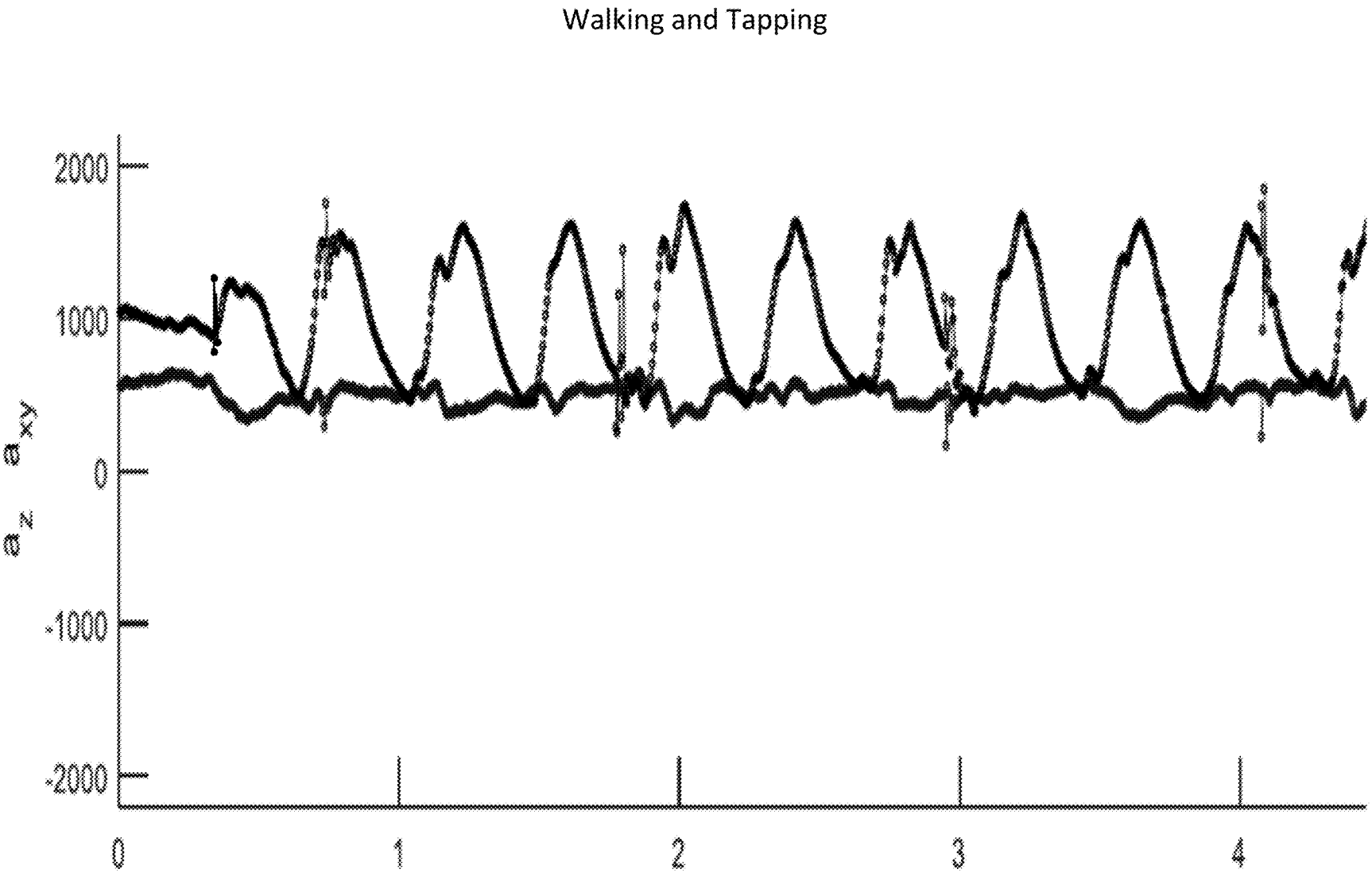

FIG. 12H illustrates an embodiment of a graph of vectors of example hearing assistance device 105. The graph may vertically plot the magnitude, such an example scale minus 2000 to positive 2000, and horizontally plot time, such as 0-5 units of time. The graph shows the vectors for Az and AXY from the accelerometer. In this example, the hearing assistance device 105 is installed in a right ear of the user and that user is taking a set of user actions of walking while sometimes also tapping. The high-frequency elements (e.g. spikes) from the taps are still highly visible even in the presence of the other vectors coming from walking. Additionally, the vectors from the tapping can be isolated and analyzed by applying a noise filter, such as a high pass filter or a two-stage noise filter.

The left/right determination module can be configured to use a noise filter to filter out noise from a gravity vector coming out of the accelerometers. The noise filter may use a low pass moving average filter with periodic sampling to look for a relatively consistent vector coming out of the accelerometers due to gravity between a series of samples and then be able filter out spurious and other inconsistent noise signals between the series of samples.

Note the signals/vectors are mapped on the coordinate system reflective of the user's left and right ears to differentiate gravity and/or a tap verses noise generating events such as chewing, driving in a car, etc.

Figure 12I:
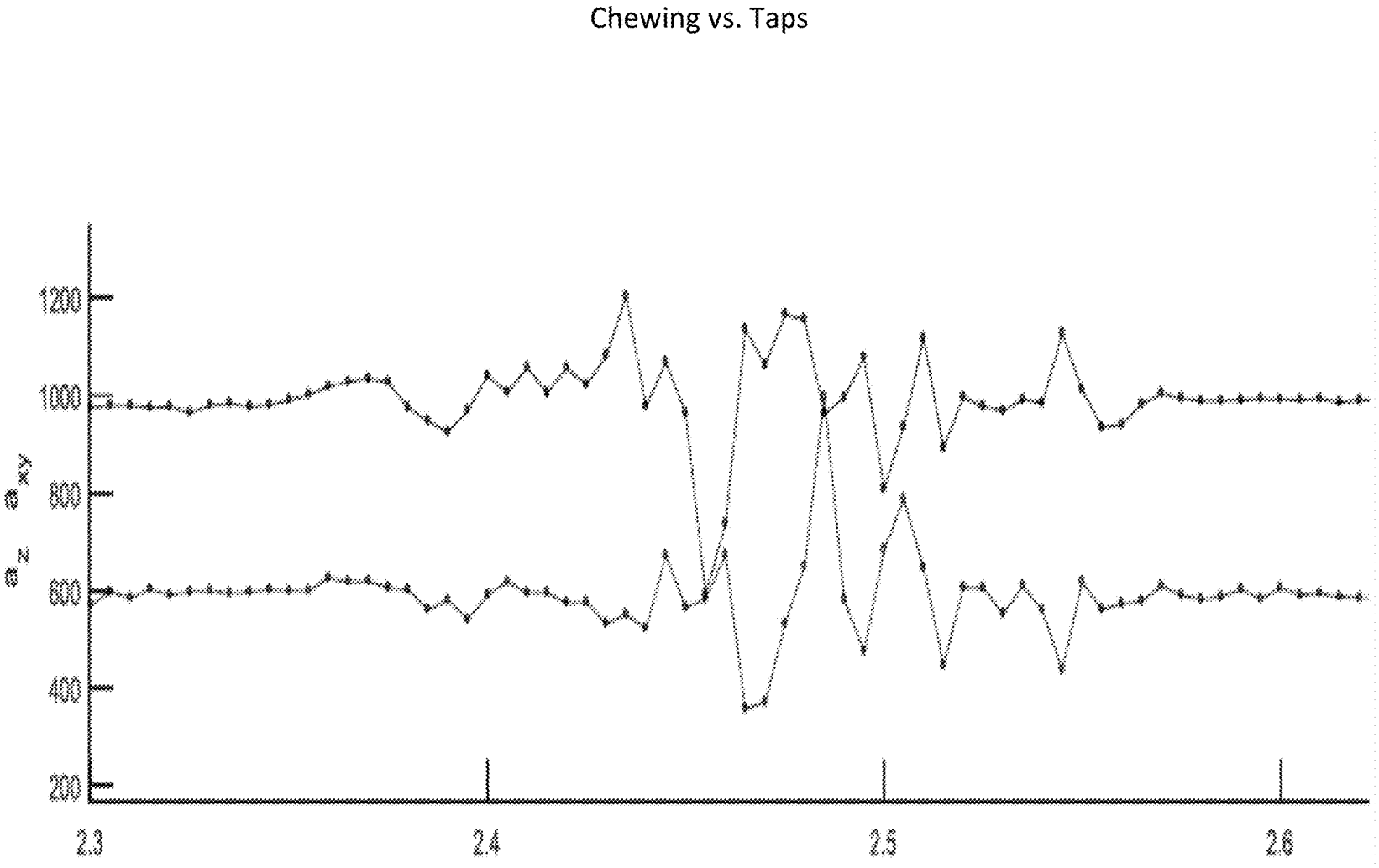

FIG. 12I illustrates an embodiment of a graph of vectors of an example hearing assistance device 105. The graph may vertically plot the magnitude, such an example scale 0 to 1200, and horizontally plot time, such as 2.3-2.6 seconds. The graph shows the vectors for Az and AXY from the accelerometer. In this example, the hearing assistance device 105 is installed in a right ear of the user and the user is remaining still sitting but chewing, e.g. a noise generating activity. A similar analysis can occur for a person remaining still sitting but driving a car and its vibrations. Taps can be differentiated from noise generating activities such as chewing and driving and thus utilize the filter to remove even these noise generating activities with some similar characteristics to taps. For one, taps on an ear or a mastoid seemed to always have a distinct rebound element with the initial spike; and thus, creating a typical spike pattern including the rebounds for a tap verses potential spike-like noise from a car or chewing.

The hearing assistance device 105 may use an "Acoustic Tap" algorithm to receive the inputs from the sensors to change sound profiles (e.g. from profile 1 to profile 2, profile 2 to profile 3, etc.), based on the accelerometer detections, capacitive pad changes in capacitance, and the sound detected in the microphone input, caused by finger taps on the ear and/or on the device itself. While the pair of hearing assistance devices 105 are inserted in the ears, the user performs a finger tap pattern, for example, "finger taps" twice. In response, the software of the hearing assistance device 105 changes the current sound profile to a new sound profile (e.g. from profile 1 to profile 2, profile 2 to profile 3, etc.). In an embodiment, One of the hearing assistance devices 105 in the pair may receive the finger tap signals in its sensors, and then convey that sound profile change to the other hearing assistance device 105. The first hearing assistance device 105 of the pair may communicate wirelessly with the other hearing assistance device 105, potentially via a paired mobile phone, to load the appropriate sound profile into that hearing assistance device 105.

The user interface for controlling a hearing assistance device 105 via use of an accelerometer to detect tap controls on the device from a user is easier and a more discreet gesture than previous techniques. In an embodiment, the hearing assistance device 105 does not need additional hardware other than what is required for other systems/functions of hearing aid. Merely the software algorithms for the user interface are added to detect the finger tap patterns and the trigger to change sound profiles is added. The finger tap patterns may cause less false-triggers of changing sound profiles than previous techniques.

In an embodiment, the accelerometer is tightly packed into the shell of the device to better detect the finger taps. The shell may be made of a rigid material having a sufficient stiffness to be able to transmit the vibrations of the finger tap in the tap area to the accelerometer.

Figure 13:
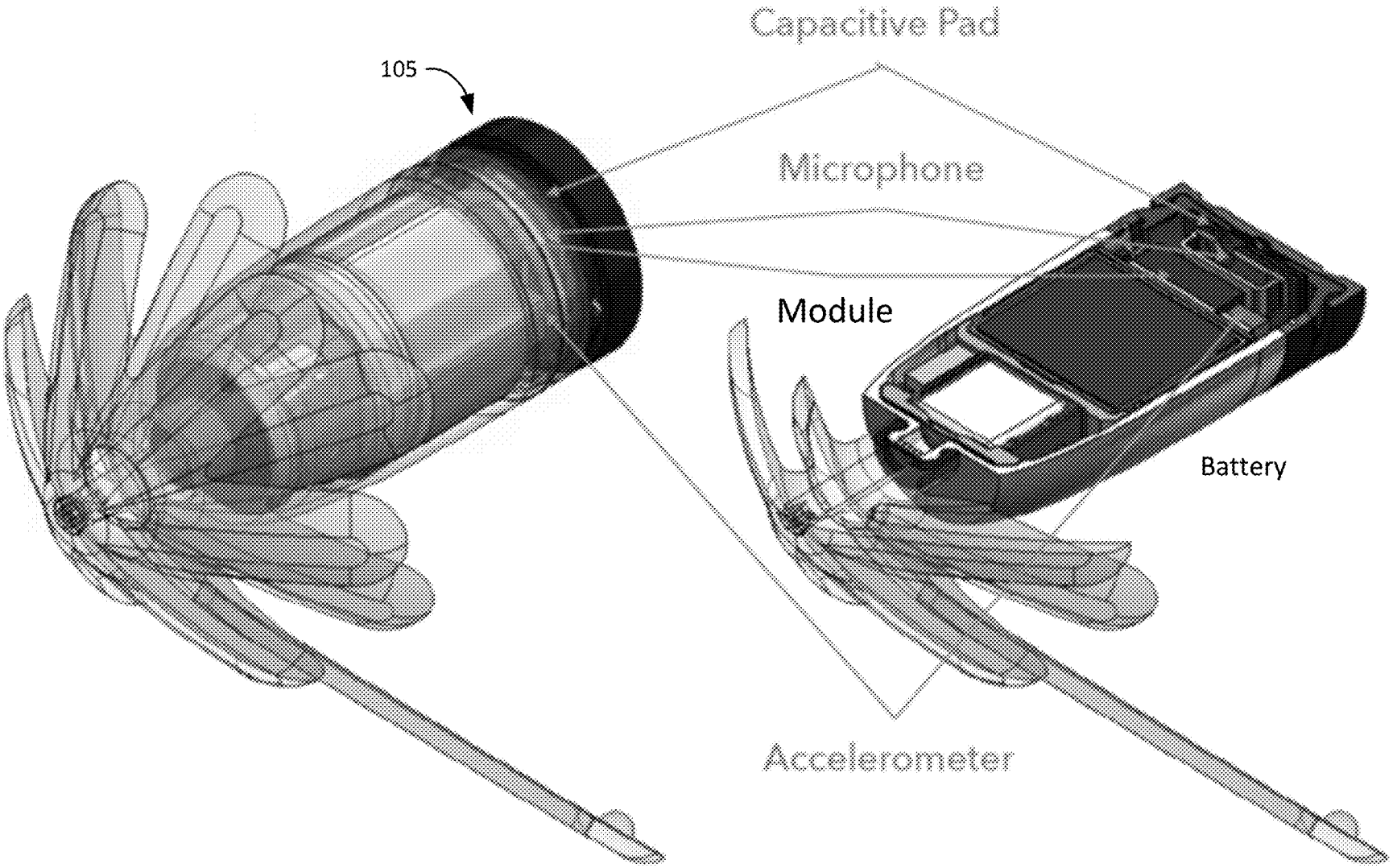
FIG. 13 illustrates an embodiment of a block diagram of an example hearing assistance device that includes an accelerometer, a microphone, a power control module with a signal processor, a battery, a capacitive pad, and other components.

FIG. 13 illustrates an embodiment of a block diagram of an example hearing assistance device 105 that includes an accelerometer, a microphone, a left/right determination module with a signal processor, a battery, a capacitive pad, and other components. The user interface is configured to use the input data for the one or more accelerometers in cooperation with input data from one or more additional sensors. The additional sensors may include but are not limited to input data from the accelerometers in combination with audio input data from a microphone, and input data from the accelerometers in combination with input data from a gyroscope to trigger the program change and/or specify which one of the program changes is attempting to be triggered.

FIG. 14 illustrates an embodiment of an exploded view of an example hearing assistance device 105 that includes an accelerometer, a microphone, a left/right determination module, a clip tip with the snap attachment and overmold, a clip tip mesh, petals/fingers of the clip tip, a shell, a shell overmold, a receiver filter, a dampener spout, a PSA spout, a receiver, a PSA frame receive side, a dampener frame, a PSA frame battery slide, a battery, isolation tape around the compartment holding the accelerometer, other sensors, modules, etc., a flex, a microphone filter, a cap, a microphone cover, and other components.

In an embodiment, an open ear canal hearing assistance device 105 may include: an electronics containing portion to assist in amplifying sound for an ear of a user; and a securing mechanism that has a flexible compressible mechanism connected to the electronics containing portion. The flexible compressible mechanism is permeable to both airflow and sound to maintain an open ear canal throughout the securing mechanism. The securing mechanism is configured to secure the hearing assistance device 105 within the ear canal, where the securing mechanism consists of a group of components selected from i) a plurality of flexible fibers, ii) one or more balloons, and iii) any combination of the two, where the flexible compressible mechanism covers at least a portion of the electronics containing portion. The flexible fiber assembly is configured to be compressible and adjustable in order to secure the hearing aid within an ear canal. A passive amplifier may connect to the electronics containing portion. The flexible fiber assembly may contact an ear canal surface when the hearing aid is in use, and providing at least one airflow path through the hearing aid or between the hearing aid and ear canal surface. The flexible fibers are made from a medical grade silicone, which is a very soft material as compared to hardened vulcanized silicon rubber. The flexible fibers may be made from a compliant and flexible material selected from a group consisting of i) silicone, ii) rubber, iii) resin, iii) elastomer, iv) latex, v) polyurethane, vi) polyamide, vii) polyimide, viii) silicone rubber, ix) nylon and x) combinations of these, but not a material that is further hardened including vulcanized rubber. Note, the plurality of fibers being made from the compliant and flexible material allows for a more comfortable extended wearing of the hearing assistance device 105 in the ear of the user.

The flexible fibers are compressible, for example, between two or more positions. The flexible fibers act as an adjustable securing mechanism to the inner ear. The plurality of flexible fibers are compressible to a collapsed position in which an angle that the flexible fibers, in the collapsed position, extend outwardly from the hearing assistance device 105 to the surface of the ear canal is smaller than when the plurality of fibers are expanded into an open position. Note, the angle of the fibers is measured relative to the electronics containing portion. The flexible fiber assembly is compressible to a collapsed position expandable to an adjustable open position, where the securing mechanism is expandable to the adjustable open position at multiple different angles relative to the ear canal in order to contact a surface of the ear canal so that one manufactured instance of the hearing assistance device 105 can be actuated into the adjustable open position to conform to a broad range of ear canal shapes and sizes.

The flexible fiber assembly may contact an ear canal surface when the hearing aid is in use, and providing at least one airflow path through the hearing aid or between the hearing aid and ear canal surface. In an embodiment, the hearing assistance device 105 may be a hearing aid, or simply an ear bud in-ear speaker, or other similar device that boosts a human hearing range frequencies. The body of the hearing aid may fit completely in the user's ear canal, safely tucked away with merely a removal thread coming out of the ear.

Because the flexible fiber assembly suspends the hearing aid device in the ear canal and doesn't plug up the ear canal, natural, ambient low (bass) frequencies pass freely to the user's eardrum, leaving the electronics containing portion to concentrate on amplifying mid and high (treble) frequencies. This combination gives the user's ears a nice mix of ambient and amplified sounds reaching the eardrum.

The hearing assistance device 105 further has an amplifier. The flexible fibers assembly is constructed with the permeable attribute to pass both air flow and sound through the fibers which allows the ear drum of the user to hear lower frequency sounds naturally without amplification by the amplifier while amplifying high frequency sounds with the amplifier to correct a user's hearing loss in that high frequency range. The set of sounds containing the lower frequency sounds is lower in frequency than a second set of sounds containing the high frequency sounds that are amplified.

The flexible fibers assembly lets air flow in and out of your ear, making the hearing assistance device 105 incredibly comfortable and breathable. And because each individual flexible fiber in the bristle assembly exerts a miniscule amount of pressure on your ear canal, the hearing assistance device 105 will feel like its merely floating in your ear while staying firmly in place.

The hearing assistance device 105 has multiple sound settings. They're highly personal and have 4 different sound profiles. These settings are designed to work for the majority of people with mild to moderate hearing loss. The sound profiles vary depending on the differences on between the hearing loss profile on a left ear and a hearing loss profile on a right ear.

FIG. 1 Illustrates an embodiment of a block diagram of an example hearing assistance device 105 cooperating with its electrical charger for that hearing assistance device 105. In the embodiment, the electrical charger may be a carrying case for the hearing assistance devices 105 with various electrical components to charge the hearing assistance devices 105 and also has additional components for other communications and functions with the hearing assistance devices 105. The user interface can utilize putting a portion of the hearing assistance device 105, such as the extension pull tab piece, to be orientated in a known vector to set a vertical orientation of the device installed in an ear in order to assist in determining whether that hearing assistance device 105 is installed in the user's left or right ear.

The hearing assistance device 105 has a battery to power at least the electronics containing portion. The battery is rechargeable, because replacing tiny batteries is a pain. The hearing assistance device 105 has rechargeable batteries with enough capacity to last all day. The hearing assistance device 105 has the permeable attribute to pass both air flow and sound through the fibers, which allows sound transmission of sounds external to the ear in a first set of frequencies to be heard naturally without amplification by the amplifier while the amplifier is configured to amplify only a select set of sounds higher in frequency than contained the first set. Merely needing to amplify a select set of frequencies in the audio range verses every frequency in the audio range makes more energy-efficient use of the hearing assistance device 105 that results in an increased battery life for the battery before needing to be recharged, and avoids over-amplification by the amplifier in the first set of frequencies that results in better hearing in both sets of frequencies for the user of the hearing assistance device 105.

Because the hearing aids fits inside the user's ear and right beside your eardrum, they amplify sound within your range of sight (as nature intended) and not behind you, like behind-the-ear devices that have microphones amplifying sound from the back of your ear. That way, the user's can track who's actually talking to the user and not get distracted by ambient noise.

Figure 4:
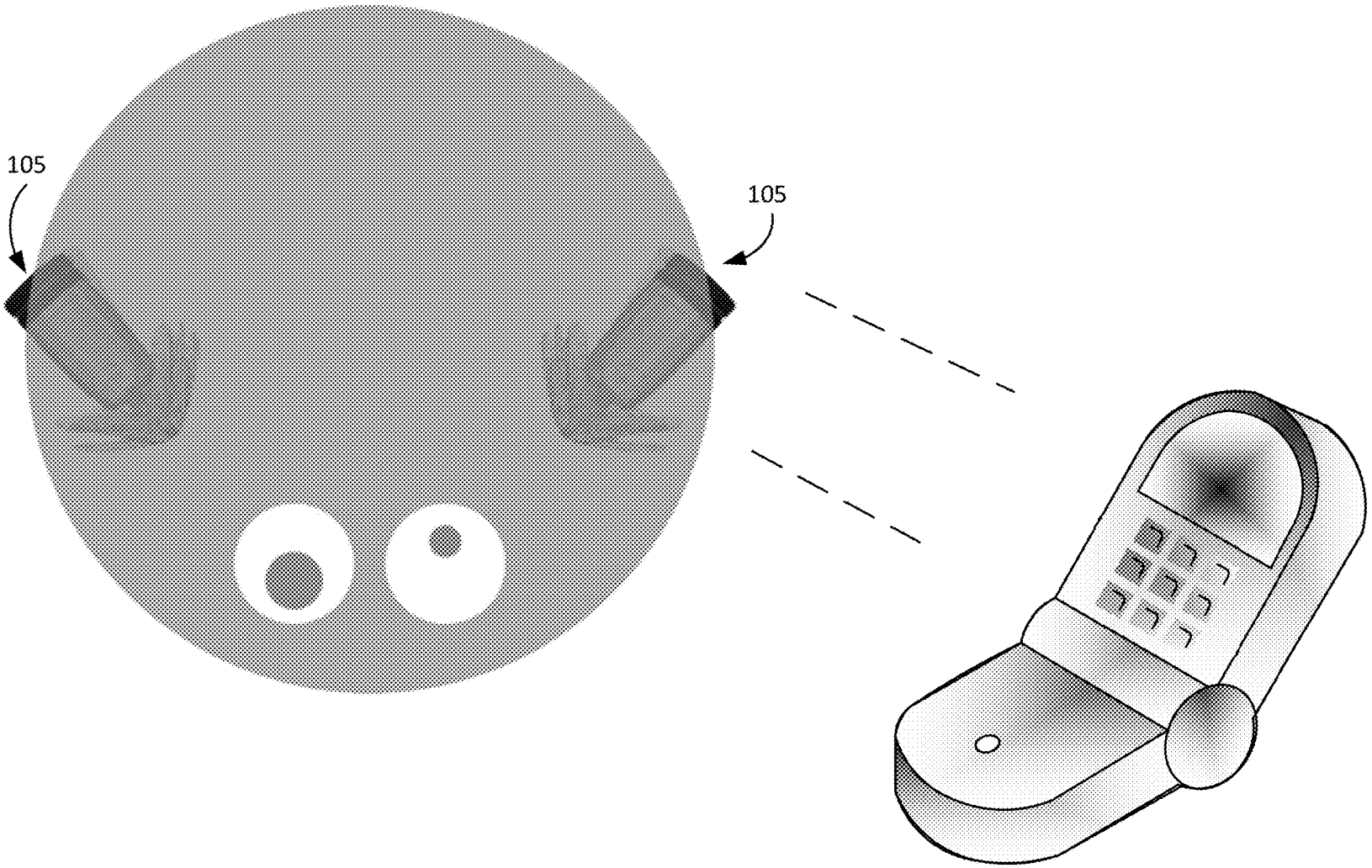
FIG. 4 illustrates an embodiment of block diagram of an example pair of hearing assistance devices each cooperating via a wireless communication module, such as Bluetooth module, to a partner application resident in a memory of a smart mobile computing device, such as a smart phone.

FIG. 4 illustrates an embodiment of block diagram of an example pair of hearing assistance devices 105 each cooperating via a wireless communication module, such as Bluetooth module, to a partner application resident in a memory of a smart mobile computing device, such as a smart phone. FIG. 4 also shows a horizontal plane view of an example orientation of the pair of hearing assistance devices 105 installed in a user's head. The left/right determination module in each hearing assistance device 105 can cooperate with a partner application resident on a smart mobile computing device. The left/right determination module, via a wireless communication circuit, sends that hearing assistance device's sensed vectors to the partner application resident on a smart mobile computing device. The partner application resident on a smart mobile computing device may compare vectors coming from a first accelerometer in the first hearing assistance device 105 to the vectors coming from a second accelerometer in the second hearing assistance device 105. The vectors in the ear on a same side where a known user activity occurs, such as tapping, will repeatably have a difference between these vectors and the vectors coming out of the accelerometer in the hearing assistance device 105 on the opposite side. In an example, each hearing assistance device 105 can use a Bluetooth connection to a smart phone and a mobile application resident in a memory of the smart phone to compare the vectors coming from a first accelerometer in the first hearing assistance device currently installed on that known side of their head to the vectors coming from a second accelerometer in the second hearing assistance device currently installed on an opposite side of their known side of their head. The partner application then can communicate the analysis back to the hearing assistance devices 105. The left/right determination module can specifically factor in that a magnitude of the vectors coming out of the accelerometer with the hearing assistance device 105 tapping on the known side of the head will have a larger magnitude than the vectors coming out of the accelerometer in the hearing assistance device 105 on the opposite side of where the tapping occurs (See FIGS. 12A-12I).

Network

FIG. 15 illustrates a number of electronic systems, including the hearing assistance device 105, communicating with each other in a network environment in accordance with some embodiments. Any two of the number of electronic devices can be the computationally poor target system and the computationally rich primary system of the distributed speech-training system. The network environment 700 has a communications network 720. The network 720 can include one or more networks selected from a body area network ("BAN"), a wireless body area network ("WBAN"), a personal area network ("PAN"), a wireless personal area network ("WPAN"), an ultrasound network ("USN"), an optical network, a cellular network, the Internet, a Local Area Network (LAN), a Wide Area Network (WAN), a satellite network, a fiber network, a cable network, or a combination thereof. In some embodiments, the communications network 720 is the BAN, WBAN, PAN, WPAN, or USN. As shown, there can be many server computing systems and many client computing systems connected to each other via the communications network 720. However, it should be appreciated that, for example, a single server computing system such the primary system can also be unilaterally or bilaterally connected to a single client computing system such as the target system in the distributed speech-training system. As such, FIG. 15 illustrates any combination of server computing systems and client computing systems connected to each other via the communications network 720.

The wireless interface of the target system can include hardware, software, or a combination thereof for communication via Bluetooth®, Bluetooth® low energy or Bluetooth® SMART, Zigbee, UWB or any other means of wireless communications such as optical, audio or ultrasound.

The communications network 720 can connect one or more server computing systems selected from at least a first server computing system 704A and a second server computing system 704B to each other and to at least one or more client computing systems as well. The server computing systems 704A and 704B can respectively optionally include organized data structures such as databases 706A and 706B. Each of the one or more server computing systems can have one or more virtual server computing systems, and multiple virtual server computing systems can be implemented by design. Each of the one or more server computing systems can have one or more firewalls to protect data integrity.

The at least one or more client computing systems can be selected from a first mobile computing device 702A (e.g., smartphone with an Android-based operating system), a second mobile computing device 702E (e.g., smartphone with an iOS-based operating system), a first wearable electronic device 702C (e.g., a smartwatch), a first portable computer 702B (e.g., laptop computer), a third mobile computing device or second portable computer 702F (e.g., tablet with an Android- or iOS-based operating system), a smart device or system incorporated into a first smart automobile 702D, a digital hearing assistance device 105, a first smart television 702H, a first virtual reality or augmented reality headset 704C, and the like. Each of the one or more client computing systems can have one or more firewalls to protect data integrity.

It should be appreciated that the use of the terms "client computing system" and "server computing system" is intended to indicate the system that generally initiates a communication and the system that generally responds to the communication. For example, a client computing system can generally initiate a communication and a server computing system generally responds to the communication. No hierarchy is implied unless explicitly stated. Both functions can be in a single communicating system or device, in which case, the a first server computing system can act as a first client computing system and a second client computing system can act as a second server computing system. In addition, the client-server and server-client relationship can be viewed as peer-to-peer. Thus, if the first mobile computing device 702A (e.g., the client computing system) and the server computing system 704A can both initiate and respond to communications, their communications can be viewed as peer-to-peer. Likewise, communications between the one or more server computing systems (e.g., server computing systems 704A and 704B) and the one or more client computing systems (e.g., client computing systems 702A and 702C) can be viewed as peer-to-peer if each is capable of initiating and responding to communications. Additionally, the server computing systems 704A and 704B include circuitry and software enabling communication with each other across the network 720.

Any one or more of the server computing systems can be a cloud provider. A cloud provider can install and operate application software in a cloud (e.g., the network 720 such as the Internet) and cloud users can access the application software from one or more of the client computing systems. Generally, cloud users that have a cloud-based site in the cloud cannot solely manage a cloud infrastructure or platform where the application software runs. Thus, the server computing systems and organized data structures thereof can be shared resources, where each cloud user is given a certain amount of dedicated use of the shared resources. Each cloud user's cloud-based site can be given a virtual amount of dedicated space and bandwidth in the cloud. Cloud applications can be different from other applications in their scalability, which can be achieved by cloning tasks onto multiple virtual machines at run-time to meet changing work demand. Load balancers distribute the work over the set of virtual machines. This process is transparent to the cloud user, who sees only a single access point.

Cloud-based remote access can be coded to utilize a protocol, such as Hypertext Transfer Protocol (HTTP), to engage in a request and response cycle with an application on a client computing system such as a mobile computing device application resident on the mobile computing device as well as a web-browser application resident on the mobile computing device. The cloud-based remote access can be accessed by a smartphone, a desktop computer, a tablet, or any other client computing systems, anytime and/or anywhere. The cloud-based remote access is coded to engage in 1) the request and response cycle from all web browser based applications, 2) SMS/twitter-based requests and responses message exchanges, 3) the request and response cycle from a dedicated on-line server, 4) the request and response cycle directly between a native mobile application resident on a client device and the cloud-based remote access to another client computing system, and 5) combinations of these.

In an embodiment, the server computing system 704A can include a server engine, a web page management component, a content management component, and a database management component. The server engine can perform basic processing and operating system level tasks. The web page management component can handle creation and display or routing of web pages or screens associated with receiving and providing digital content and digital advertisements. Users (e.g., cloud users) can access one or more of the server computing systems by means of a Uniform Resource Locator (URL) associated therewith. The content management component can handle most of the functions in the embodiments described herein. The database management component can include storage and retrieval tasks with respect to the database, queries to the database, and storage of data.

An embodiment of a server computing system to display information, such as a web page, etc. is discussed. An application including any program modules, applications, services, processes, and other similar software executable when executed on, for example, the server computing system 704A, causes the server computing system 704A to display windows and user interface screens on a portion of a media space, such as a web page. A user via a browser from, for example, the client computing system 702A, can interact with the web page, and then supply input to the query/fields and/or service presented by a user interface of the application. The web page can be served by a web server, for example, the server computing system 704A, on any Hypertext Markup Language (HTML) or Wireless Access Protocol (WAP) enabled client computing system (e.g., the client computing system 702A) or any equivalent thereof. For example, the client mobile computing system 702A can be a wearable electronic device, smartphone, a tablet, a laptop, a netbook, etc. The client computing system 702A can host a browser, a mobile application, and/or a specific application to interact with the server computing system 704A. Each application has a code scripted to perform the functions that the software component is coded to carry out such as presenting fields and icons to take details of desired information. Algorithms, routines, and engines within, for example, the server computing system 704A can take the information from the presenting fields and icons and put that information into an appropriate storage medium such as a database (e.g., database 706A). A comparison wizard can be scripted to refer to a database and make use of such data. The applications can be hosted on, for example, the server computing system 704A and served to the browser of, for example, the client computing system 702A. The applications then serve pages that allow entry of details and further pages that allow entry of more details.

Example Computing Systems

FIG. 16 illustrates a computing system that can be part of one or more of the computing devices such as the mobile phone, portions of the hearing assistance device, etc. in accordance with some embodiments. With reference to FIG. 16, components of the computing system 800 can include, but are not limited to, a processing unit 820 having one or more processing cores, a system memory 830, and a system bus 821 that couples various system components including the system memory 830 to the processing unit 820. The system bus 821 can be any of several types of bus structures selected from a memory bus or memory controller, a peripheral bus, and a local bus using any of a variety of bus architectures.

Computing system 800 can include a variety of computing machine-readable media. Computing machine-readable media can be any available media that can be accessed by computing system 800 and includes both volatile and non-volatile media, and removable and non-removable media. By way of example, and not limitation, computing machine-readable media use includes storage of information, such as computer-readable instructions, data structures, other executable software or other data. Computer-storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other tangible medium which can be used to store the desired information and which can be accessed by the computing device 800. Transitory media such as wireless channels are not included in the machine-readable media. Communication media typically embody computer readable instructions, data structures, other executable software, or other transport mechanism and includes any information delivery media. As an example, some client computing systems on the network 220 of FIG. 16 might not have optical or magnetic storage.

The system memory 830 includes computer storage media in the form of volatile and/or nonvolatile memory such as read only memory (ROM) 831 and random access memory (RAM) 832. A basic input/output system 833 (BIOS) containing the basic routines that help to transfer information between elements within the computing system 800, such as during start-up, is typically stored in ROM 831. RAM 832 typically contains data and/or software that are immediately accessible to and/or presently being operated on by the processing unit 820. By way of example, and not limitation, FIG. 16 illustrates that RAM 832 can include a portion of the operating system 834, application programs 835, other executable software 836, and program data 837.

The computing system 800 can also include other removable/non-removable volatile/nonvolatile computer storage media. By way of example only, FIG. 16 illustrates a solid-state memory 841. Other removable/non-removable, volatile/nonvolatile computer storage media that can be used in the example operating environment include, but are not limited to, USB drives and devices, flash memory cards, solid state RAM, solid state ROM, and the like. The solid-state memory 841 is typically connected to the system bus 821 through a non-removable memory interface such as interface 840, and USB drive 851 is typically connected to the system bus 821 by a removable memory interface, such as interface 850.

The drives and their associated computer storage media discussed above and illustrated in FIG. 16 provide storage of computer readable instructions, data structures, other executable software and other data for the computing system 800. In FIG. 16, for example, the solid state memory 841 is illustrated for storing operating system 844, application programs 845, other executable software 846, and program data 847. Note that these components can either be the same as or different from operating system 834, application programs 835, other executable software 836, and program data 837. Operating system 844, application programs 845, other executable software 846, and program data 847 are given different numbers here to illustrate that, at a minimum, they are different copies.

A user can enter commands and information into the computing system 800 through input devices such as a keyboard, touchscreen, or software or hardware input buttons 862, a microphone 863, a pointing device and/or scrolling input component, such as a mouse, trackball or touch pad. The microphone 863 can cooperate with speech recognition software on the target system or primary system as appropriate. These and other input devices are often connected to the processing unit 820 through a user input interface 860 that is coupled to the system bus 821, but can be connected by other interface and bus structures, such as a parallel port, game port, or a universal serial bus (USB). A display monitor 891 or other type of display screen device is also connected to the system bus 821 via an interface, such as a display interface 890. In addition to the monitor 891, computing devices can also include other peripheral output devices such as speakers 897, a vibrator 899, and other output devices, which can be connected through an output peripheral interface 895.

The computing system 800 can operate in a networked environment using logical connections to one or more remote computers/client devices, such as a remote computing system 880. The remote computing system 880 can be a personal computer, a hand-held device, a server, a router, a network PC, a peer device or other common network node, and typically includes many or all of the elements described above relative to the computing system 800. The logical connections depicted in FIG. 15 can include a personal area network ("PAN") 872 (e.g., Bluetooth®), a local area network ("LAN") 871 (e.g., Wi-Fi), and a wide area network ("WAN") 873 (e.g., cellular network), but can also include other networks such as an ultrasound network ("USN"). Such networking environments are commonplace in offices, enterprise-wide computer networks, intranets and the Internet. A browser application can be resident on the computing device and stored in the memory.

When used in a LAN networking environment, the computing system 800 is connected to the LAN 871 through a network interface or adapter 870, which can be, for example, a Bluetooth® or Wi-Fi adapter. When used in a WAN networking environment (e.g., Internet), the computing system 800 typically includes some means for establishing communications over the WAN 873. With respect to mobile telecommunication technologies, for example, a radio interface, which can be internal or external, can be connected to the system bus 821 via the network interface 870, or other appropriate mechanism. In a networked environment, other software depicted relative to the computing system 800, or portions thereof, can be stored in the remote memory storage device. By way of example, and not limitation, FIG. 16 illustrates remote application programs 885 as residing on remote computing device 880. It will be appreciated that the network connections shown are examples and other means of establishing a communications link between the computing devices can be used.

As discussed, the computing system 800 can include a processor 820, a memory (e.g., ROM 831, RAM 832, etc.), a built in battery to power the computing device, an AC power input to charge the battery, a display screen, a built-in Wi-Fi circuitry to wirelessly communicate with a remote computing device connected to network.

It should be noted that the present design can be carried out on a computing system such as that described with respect to FIG. 16. However, the present design can be carried out on a server, a computing device devoted to message handling, or on a distributed system such as the distributed speech-training system in which different portions of the present design are carried out on different parts of the distributed computing system.

Another device that can be coupled to bus 821 is a power supply such as a DC power supply (e.g., battery) or an AC adapter circuit. As discussed above, the DC power supply can be a battery, a fuel cell, or similar DC power source that needs to be recharged on a periodic basis. A wireless communication module can employ a Wireless Application Protocol to establish a wireless communication channel. The wireless communication module can implement a wireless networking standard.

In some embodiments, software used to facilitate algorithms discussed herein can be embodied onto a non-transitory machine-readable medium. A machine-readable medium includes any mechanism that stores information in a form readable by a machine (e.g., a computer). For example, a non-transitory machine-readable medium can include read only memory (ROM); random access memory (RAM); magnetic disk storage media; optical storage media; flash memory devices; Digital Versatile Disc (DVD's), EPROMs, EEPROMs, FLASH memory, magnetic or optical cards, or any type of media suitable for storing electronic instructions.

Note, an application described herein includes but is not limited to software applications, mobile apps, and programs that are part of an operating system application. Some portions of this description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. These algorithms can be written in a number of different software programming languages such as C, C+, or other similar languages. Also, an algorithm can be implemented with lines of code in software, configured logic gates in software, or a combination of both. In an embodiment, the logic consists of electronic circuits that follow the rules of Boolean Logic, software that contain patterns of instructions, or any combination of both.

It should be borne in mind, however, that all of these and similar terms are to be associated with the appropriate physical quantities and are merely convenient labels applied to these quantities. Unless specifically stated otherwise as apparent from the above discussions, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers, or other such information storage, transmission or display devices.

Many functions performed by electronic hardware components can be duplicated by software emulation. Thus, a software program written to accomplish those same functions can emulate the functionality of the hardware components in input-output circuitry.

While the foregoing design and embodiments thereof have been provided in considerable detail, it is not the intention of the applicant(s) for the design and embodiments provided herein to be limiting. Additional adaptations and/or modifications are possible, and, in broader aspects, these adaptations and/or modifications are also encompassed. Accordingly, departures can be made from the foregoing design and embodiments without departing from the scope afforded by the following claims, which scope is only limited by the claims when appropriately construed.

What is claimed is:

1. An apparatus, comprising:

a hearing assistance device having one or more accelerometers and a user interface is configured to receive input data from the one or more accelerometers from user actions causing control signals as sensed by the accelerometers to trigger a program change for an audio configuration for the device selected from a group consisting of a change in amplification/volume control, a change in a mute mode, a change of a hearing loss profile loaded into that hearing assistance device, and a change in a play-pause mode, where the user interface is configured to cooperate with a left/right determination module, where the left/right determination module is configured to make a determination and recognize whether the hearing assistance device is installed on a left side or right side of a user, and the user interface is configured to receive the control signals as sensed by the accelerometers to trigger an autonomous loading of the hearing loss profile corresponding to the left or right ear based on the determination made by the left/right determination module, where the hearing assistance device is implemented in a device selected from a group consisting of a hearing aid, a speaker, a smart watch, a smart phone, ear phones, head phones, or ear buds, where vectors from the one or more accelerometers are used to recognize the hearing assistance device's orientation relative to a coordinate system reflective of the user's left and right ears, where one or more algorithms in the left/right determination module analyze the vectors on the coordinate system and determine whether the device is currently inserted in the left or right ear.

2. The apparatus of claim 1, where the user interface is configured to use the input data from the one or more accelerometers in cooperation with input data from one or more additional sensors including but not limited to input data from the accelerometers in combination with audio input data from a microphone, and input data from the accelerometers in combination with input data from a gyroscope to trigger the program change and/or specify which one of the program changes is attempting to be triggered.

3. The apparatus of claim 1, where the user interface, the one or more accelerometers, and the left/right determination module are configured to cooperate to determine whether the hearing assistance device is installed on the left side or right side of the user via an analysis of a current set of vectors of orientation sensed by the accelerometers when the user taps a known side of their head and any combination of a resulting i) magnitude of the vectors, ii) an amount of taps and a corresponding amount of spikes in the vectors, and iii) a frequency cadence of a series of taps and how the vectors correspond to a timing of the cadence.

4. The apparatus of claim 1, where the left/right determination module in each hearing assistance device is configured to cooperate with a partner application resident on a smart mobile computing device, which is one of the smart watch and the smart phone, via a wireless communication circuit, to send that hearing assistance device's sensed vectors to the partner application resident on the smart mobile computing device, where the partner application resident on the smart mobile computing device is configured to compare vectors coming from a first accelerometer in the hearing assistance device to the vectors coming from a second accelerometer in an another hearing assistance device.

5. The apparatus of claim 1, where the left/right determination module is configured to use a noise filter to filter out noise from a gravity vector coming out of the accelerometers, where the noise filter uses a low pass moving average filter with periodic sampling to look for a relatively consistent vector coming out of the accelerometers due to gravity between a series of samples and then be able filter out spurious and other inconsistent noise signals between the series of samples.

6. The apparatus of claim 1, where the left/right determination module is configured to use a gravity vector averaged over time into its determination of whether the hearing assistance device is installed in the left or right ear of the user.

7. The apparatus of claim 1, where the user interface is configured to utilize putting a portion of the hearing assistance device to be orientated in a known vector to set a vertical orientation of the hearing assistance device installed in an ear in order to assist in determining whether that hearing assistance device is installed in the user's left or right ear.

8. The apparatus of claim 1, where the user actions causing control signals as sensed by the accelerometers is a sequence of one or more taps to initiate the determination of which ear the hearing assistance device is inserted in and then the user interface prompts the user to do another set of user actions to move their head in a known direction so the vectors coming out of the one or more accelerometers can be checked against an expected set of vectors when the hearing assistance device is moved in that known direction.

9. A method for a hearing assistance device, comprising:

configuring the hearing assistance device to have one or more accelerometers and a user interface;

configuring a user interface to receive input data from the one or more accelerometers from user actions to cause control signals as sensed by the accelerometers to trigger a program change for an audio configuration for the hearing assistance device, where the program changes are selected from a group consisting of a change in amplification/volume control, a change in a mute mode, a change of a hearing loss profile loaded into that hearing assistance device, and a change in a play/pause mode;

configuring the user interface to cooperate with a left/right determination module; and configuring the left/right determination module to make a determination and recognize whether the hearing assistance device is installed on a left side or right side of a user, and where the user interface is configured to receive the control signals as sensed by the accelerometers to trigger an autonomous loading of the hearing loss profile corresponding to the left or right ear based on the determination made by the left/right determination module, where the hearing assistance device is implemented in a device selected from a group consisting of a hearing aid, a speaker, a smart watch, a smart phone, ear phones, head phones, or ear buds, where vectors from the one or more accelerometers are used to recognize the hearing assistance device's orientation relative to a coordinate system reflective of the user's left and right ears, where one or more algorithms in the left/right determination module analyze the vectors on the coordinate system and determine whether the device is currently inserted in the left or right ear.

10. The method of claim 9, further comprising:

configuring the user interface to use the input data from the one or more accelerometers in cooperation with input data from one or more additional sensors, where additional sensors include input data from the accelerometers in combination with audio input data from a microphone, and input data from the accelerometers in combination with input data from a gyroscope to trigger the program change and/or specify which one of the program changes is attempting to be triggered.

11. The method of claim 9, further comprising:

configuring the user interface, the one or more accelerometers, and the left/right determination module to cooperate to determine whether the hearing assistance device is installed on the left side or right side of the user via an analysis of a current set of vectors of orientation sensed by the accelerometers when the user taps a known side of their head and any combination of a resulting i) magnitude of the vectors, ii) an amount of taps and a corresponding amount of spikes in the vectors, and iii) a frequency cadence of a series of taps and how the vectors correspond to a timing of the cadence.

12. A method for a hearing assistance device, comprising:

configuring the hearing assistance device to have one or more accelerometers and a user interface;

configuring a user interface to receive input data from the one or more accelerometers from user actions to cause control signals as sensed by the accelerometers to trigger a program change for an audio configuration for the hearing assistance device, where the program changes are selected from a group consisting of a change in amplification/volume control, a change in a mute mode, a change of a hearing loss profile loaded into that hearing assistance device, and a change in a play/pause mode;

configuring the user interface to cooperate with a left/right determination module;

configuring the left/right determination module to make a determination and recognize whether the hearing assistance device is installed on a left side or right side of a user, and where the user interface is configured to receive the control signals as sensed by the accelerometers to trigger an autonomous loading of the hearing loss profile corresponding to the left or right ear based on the determination made by the left/right determination module configuring the left/right determination module in each hearing assistance device to cooperate with a partner application resident on a smart mobile computing device, via a wireless communication circuit, to send that hearing assistance device's sensed vectors to the partner application resident on the smart mobile computing device, where the partner application resident on the smart mobile computing device is configured to compare vectors coming from a first accelerometer in the hearing assistance device to the vectors coming from a second accelerometer in an another hearing assistance device.

13. The method of claim 9, further comprising:

configuring the left/right determination module to use a noise filter to filter out noise from a gravity vector coming out of the accelerometers, where the noise filter uses a low pass moving average filter with periodic sampling to look for a relatively consistent vector coming out of the accelerometers due to gravity between a series of samples and then be able filter out spurious and other inconsistent noise signals between the series of samples.

14. The method of claim 9, further comprising:

configuring the left/right determination module to use a gravity vector averaged over time into its determination of whether the hearing assistance device is installed in the left or right ear of the user.

15. The method of claim 9, where the user interface is configured to utilize putting a portion of the hearing assistance device to be orientated in a known vector to set a vertical orientation of the hearing assistance device installed in an ear in order to assist in determining whether that hearing assistance device is installed in the user's left or right ear.

16. The method of claim 9, further comprising:

configuring the user actions to cause control signals as sensed by the accelerometers to be a sequence of one or more taps to initiate the determination of which ear the hearing assistance device is inserted in and then the user interface prompts the user to do another set of user actions to move their head in a known direction so the vectors coming out of the one or more accelerometers can be checked against an expected set of vectors when the hearing assistance device is moved in that known direction.

* * * * *